US011741893B2

(12) United States Patent
Yoon et al.

(10) Patent No.: US 11,741,893 B2
(45) Date of Patent: Aug. 29, 2023

(54) DISPLAY DEVICE AND METHOD OF DRIVING DISPLAY DEVICE

(71) Applicant: Samsung Display Co., Ltd., Yongin-si (KR)

(72) Inventors: Changnoh Yoon, Seoul (KR); Sangan Kwon, Cheonan-si (KR); Soon-Dong Kim, Osan-si (KR); Taehoon Kim, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/864,798

(22) Filed: Jul. 14, 2022

(65) Prior Publication Data

US 2023/0129065 A1 Apr. 27, 2023

(30) Foreign Application Priority Data

Oct. 22, 2021 (KR) ..... 10-2021-0141824

(51) Int. Cl.
*G09G 5/00* (2006.01)
*G09G 3/3225* (2016.01)

(52) U.S. Cl.
CPC ... *G09G 3/3225* (2013.01); *G09G 2300/0842* (2013.01); *G09G 2320/0271* (2013.01); *G09G 2320/0626* (2013.01)

(58) Field of Classification Search
CPC ..... G09G 3/3225; G09G 2310/0243; G09G 2310/08; G09G 2300/0842; G09G 2300/0426; G09G 2320/0271; G09G 2320/0626; G09G 2330/021
USPC ..... 345/204
See application file for complete search history.

(56) References Cited

U.S. PATENT DOCUMENTS 10,878,752 B1 * 12/2020 Li ..... G09G 3/3225
2016/0042687 A1 * 2/2016 Jeong ..... G09G 3/3233 345/690
2016/0232849 A1 * 8/2016 Jeon ..... G09G 3/3233
2021/0049959 A1 * 2/2021 Park ..... G09G 3/325
2021/0400229 A1 * 12/2021 Chen ..... G06V 20/40

FOREIGN PATENT DOCUMENTS

KR 101371243 B1 3/2014

* cited by examiner

*Primary Examiner* — Jennifer T Nguyen
(74) *Attorney, Agent, or Firm* — CANTOR COLBURN LLP

(57) ABSTRACT

A display device includes a display panel, a power supply unit, and a low frequency offset compensator. The display panel includes a plurality of pixels. The power supply unit generates a first initialization voltage and a second initialization voltage and provides the first initialization voltage and the second initialization voltage to the pixels. The low frequency offset compensator selectively applies an offset to the second initialization voltage when the display panel is driven at a low frequency.

19 Claims, 19 Drawing Sheets

FIG. 11

| DBV | 255G(nit) | Min Gray (0.2nit) | Max Gray (1nit) |
|---|---|---|---|
| n | 1000 | 6 | 11 |
| ... | ... | ... | ... |
| 4 | 183 | 12 | 24 |
| 3 | 98 | 16 | 32 |
| 2 | 50 | 21 | 44 |
| 1 | 2 | 90 | 187 |

DISPLAY DEVICE AND METHOD OF DRIVING DISPLAY DEVICE

This application claims priority to Korean Patent Application No. 10-2021-0141824, filed on Oct. 22, 2021, and all the benefits accruing therefrom under 35 U.S.C. § 119, the content of which in its entirety is herein incorporated by reference.

BACKGROUND

1. Field

Embodiments relate generally to a display device and a method of driving a display device. More particularly, embodiments of the invention relate to a display device performing a multi frequency driving a method of driving a display device performing a multi frequency driving.

2. Description of the Related Art

Flat panel display devices are used as display devices for replacing a cathode ray tube display device due to lightweight and thin characteristics thereof. As representative examples of such flat panel display devices include a liquid crystal display device, an organic light-emitting display device, a quantum dot display device, or the like.

Recently, a display device that may be driven at various frequencies is being developed, and in order to increase efficiency of a battery included in the display device, it is desired to reduce power consumption of pixels included in the display device. In order to reduce the power consumption of the pixels, when the pixels display a still image (or when the pixels are driven at a low frequency), a driving frequency of the pixels may be reduced so that the display device may be driven at a low frequency. In this case, when the display device is driven at the low frequency, a luminance may be decreased as a low-frequency driving time increases. In order to solve the above problem, an offset may be applied to a power supply for initializing a light-emitting element included in the pixel, so that the decreased luminance may be compensated for.

SUMMARY

When compensating for decreased luminance by applying an offset to a power supply, a luminance deviation may occur at a specific luminance or higher.

Embodiments provide a display device.

Embodiments provide a method of driving a display device.

In an embodiment of the invention, a display device includes a display panel, a power supply unit, and a low frequency offset compensator. The display panel includes a plurality of pixels. The power supply unit generates a first initialization voltage and a second initialization voltage and provides the first initialization voltage and the second initialization voltage to the plurality of pixels. The low frequency offset compensator selectively applies an offset to the second initialization voltage when the display panel is driven at a low frequency.

In an embodiment, the low frequency offset compensator may measure a number of pixel data corresponding within a preset low gray level range based on gray level information of the pixel data included in image data.

In an embodiment, the low frequency offset compensator may apply the offset to the second initialization voltage when the number of the pixel data corresponding within the preset low gray level range is greater than or equal to a preset number.

In an embodiment, the low frequency offset compensator may not apply the offset to the second initialization voltage when the number of the pixel data corresponding within the preset low gray level range is less than or equal to a preset criterion.

In an embodiment, the preset low gray level range may be from about 0.2 nit to about 1 nit.

In an embodiment, the low frequency offset compensator may include a memory, a calculator, and a compensation signal generator. The memory may store display brightness value ("DBV") data and a low gray level range corresponding to each of the DBV data. The calculator may determine whether the display panel is driven at the low frequency based on the image data, select DBV data corresponding to a brightness of the display panel, and determine a low gray level range of the selected DBV data. The compensation signal generator may generate a compensation signal and provide the compensation signal to the power supply unit.

In an embodiment, the low frequency offset compensator may determine whether pixel data corresponding to an index pixel group corresponding to at least four discrete pixels selected from pixels arranged in a pixel row among the pixels is within a low gray level range.

In an embodiment, the low frequency offset compensator may apply the offset to the second initialization voltage when the pixel data corresponding to an index pixel within the low gray level range is greater than or equal to a preset criterion.

In an embodiment, the low frequency offset compensator may determine whether pixel data corresponding to a window index corresponding to at least four consecutive pixels selected from pixels arranged in a pixel row among the plurality of pixels is within a low gray level range.

In an embodiment, the low frequency offset compensator may apply the offset to the second initialization voltage when the pixel data corresponding to a window index pixel within the low gray level range is greater than or equal to a preset criterion.

In an embodiment, each of the pixels may include a light-emitting element and a driving transistor. The light-emitting element may output a light based on a driving current, and may include a first terminal and a second terminal. The driving transistor may generate the driving current, and may include a first terminal to which a first power supply voltage is applied, a second terminal connected to the first terminal of the light-emitting element, and a gate terminal to which the first initialization voltage is applied.

In an embodiment, each of the plurality of pixels may further include a first switching transistor including a first terminal to which the second initialization voltage is applied, a second terminal connected to the first terminal of the light-emitting element, and a gate terminal to which a data write gate signal is applied.

In an embodiment, the first switching transistor may initialize the first terminal of the light-emitting element to the second initialization voltage during an activation period of the data write gate signal.

In an embodiment, each of the plurality of pixels may further include a second switching transistor including a first terminal to which the first initialization voltage is applied, a second terminal connected to the gate terminal of the driving transistor, and a gate terminal to which a data initialization gate signal is applied.

In an embodiment, the second switching transistor may initialize the gate terminal of the driving transistor to the first initialization voltage during an activation period of the data initialization gate signal.

In an embodiment of the invention, a method of driving a display device is provided as follows. It is determined whether to perform low-frequency driving based on image data. A low gray level range of display brightness value ("DBV") data corresponding to a brightness of a display panel among the DBV data is determined. It is determined whether pixel data is within a preset low gray level range. A number of the pixel data within the low gray level range is measured. It is determined whether a number of low gray level pixel data of frame data is greater than or equal to a preset number. An offset of a second initialization voltage in a holding frame is applied when the number of the low gray level pixel data of the frame data is greater than or equal to the preset number.

In an embodiment, the preset low gray level range may be from about 0.2 nit to about 1 nit.

In an embodiment, the method may further include determining whether pixel data corresponding to an index pixel is within the preset low gray level range and determining whether the pixel data corresponding to the index pixel is greater than or equal to a preset criterion.

In an embodiment, the method may further include determining whether pixel data corresponding to a window index pixel is within the preset low gray level range and determining whether the pixel data corresponding to the window index pixel is consecutive.

In an embodiment, the method may further include maintaining the second initialization voltage in the holding frame when the number of the low gray level pixel data of the frame data is less than or equal to the preset number.

Since the display device in the embodiments of the invention includes the low frequency offset compensator, when the display panel is driven at a low frequency, the luminance deviation may be prevented from occurring in the pixels of the display panel by selectively applying the offset to the second initialization voltage.

In addition, since the display device selectively applies the offset to the second initialization voltage, power consumption of the display device may be relatively reduced.

Furthermore, when frame data in which the brightness of the display panel exceeds about 1 nit includes a low-luminance pattern, the display device may apply the offset to the second initialization voltage so that the luminance deviation that may occur in the pixels of the display panel may be reduced.

BRIEF DESCRIPTION OF THE DRAWINGS

Embodiments may be understood in more detail from the following description taken in conjunction with the accompanying drawings.

FIGS. 11, 12, 13, 14, 15, and 16 are views for describing the method of driving the display device of FIG. 10.

DETAILED DESCRIPTION

Figure 1:
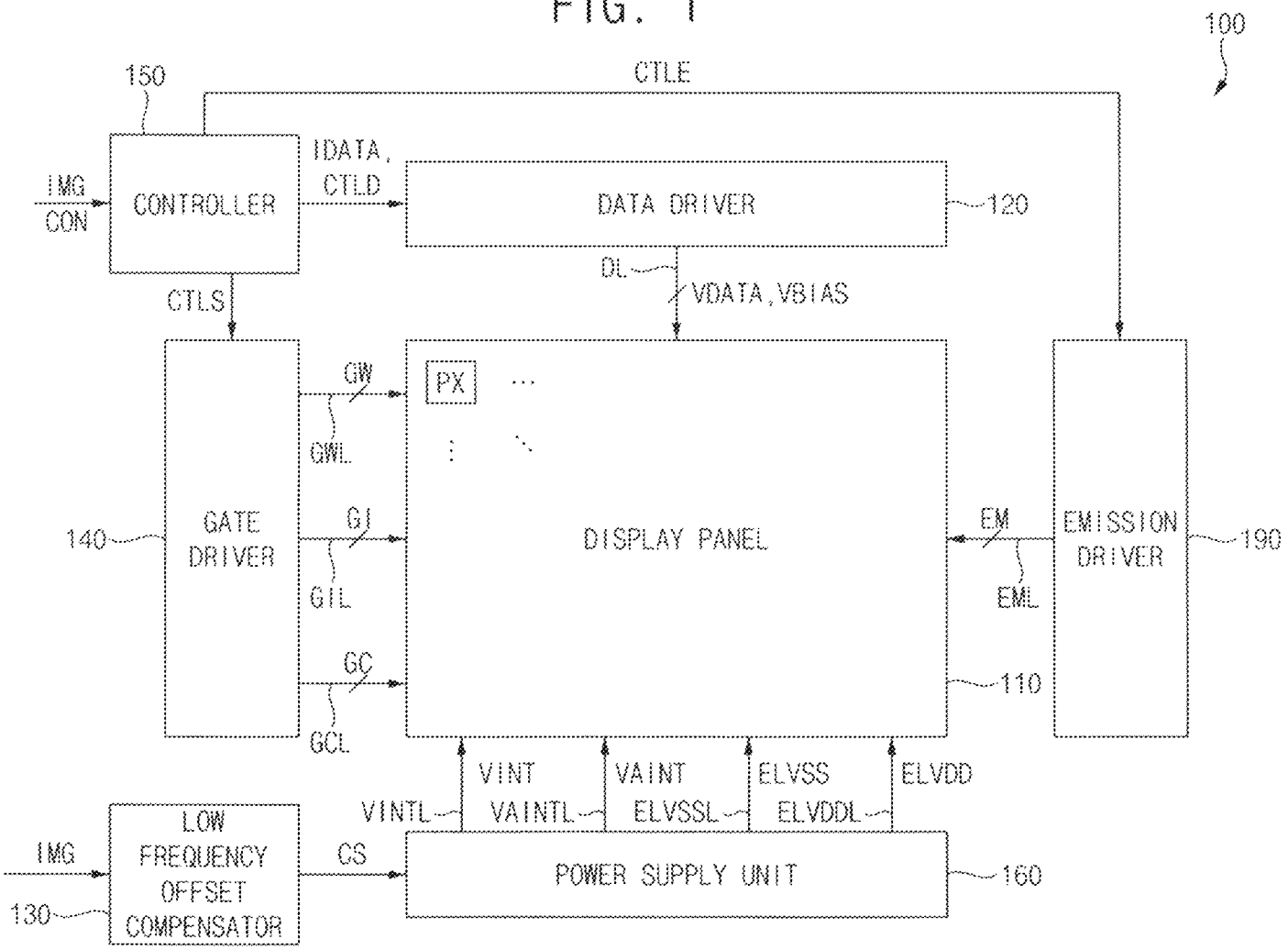
FIG. 1 is a block diagram showing an embodiment of a display device according to the invention.

Hereinafter, display devices and methods of driving display device in embodiments of the invention will be described in detail with reference to the accompanying drawings. In the accompanying drawings, same or similar reference numerals refer to the same or similar elements.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). The term "about" can mean within one or more standard deviations, or within ±30%, 20%, 10%, 5% of the stated value, for example.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Figure 2:
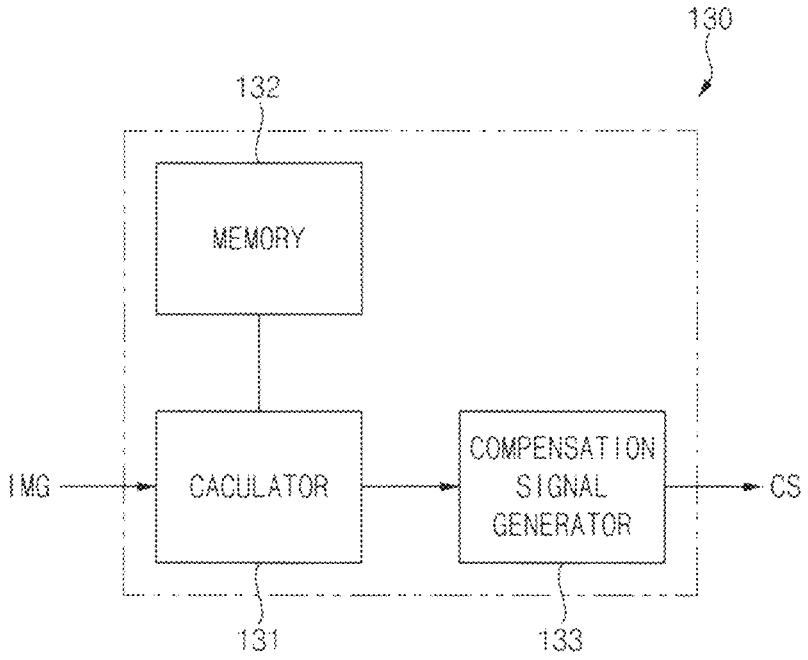
FIG. 2 is a block diagram for describing a low frequency offset compensator included in the display device of FIG. 1.

FIG. 1 is a block diagram showing an embodiment of a display device of the invention, and FIG. 2 is a block diagram for describing a low frequency offset compensator included in the display device of FIG. 1.

Referring to FIG. 1, a display device 100 may include a display panel 110 including a plurality of pixels PX, a controller 150, a data driver 120, a gate driver 140, an emission driver 190, a power supply unit 160, a low frequency offset compensator 130, or the like. In this case, the low frequency offset compensator 130 may include a calculator 131, a memory 132, and a compensation signal generator 133.

In an embodiment, the display device 100 may display an image at various driving frequencies (or image refresh rates or screen refresh rates) according to driving conditions.

The display panel 110 may include a plurality of data lines DL, a plurality of data write gate lines GWL, a plurality of data initialization gate lines GIL, a plurality of compensation gate lines GCL, a plurality of emission lines EML, a plurality of first power supply voltage lines ELVDDL, a plurality of second power supply voltage lines ELVSSL, a plurality of first initialization voltage lines VINTL, a plurality of second initialization voltage lines VAINTL, and a plurality of pixels PX connected to the lines.

In an embodiment, each of the pixels PX may include at least two transistors, at least one capacitor, and a light-emitting element, and the display panel 110 may be a light-emitting display panel. In an embodiment, the display panel 110 may be a display panel of an organic light-emitting display device. In other embodiments, the display panel 110 may include a display panel of an inorganic light-emitting display device ("ILED"), a display panel of a quantum dot display device ("QDD"), a display panel of a liquid crystal display device ("LCD"), a display panel of a field emission display device ("FED"), a display panel of a plasma display device ("PDP"), or a display panel of an electrophoretic display device ("EPD").

The controller 150 (e.g., a timing controller ("T-CON")) may receive image data IMG and an input control signal CON from an external host processor (e.g., an application processor ("AP"), a graphic processing unit ("GPU"), or a graphic card). The image data IMG may be RGB image data (or RGB pixel data) including red image data (or red pixel data), green image data (or green pixel data), and blue image data (or blue pixel data). In addition, the image data IMG may include information on a driving frequency. The input control signal CON may include a vertical synchronization signal, a horizontal synchronization signal, an input data enable signal, a master clock signal, or the like, but the invention is not limited thereto.

The controller 150 may convert the image data IMG into input image data IDATA by applying an algorithm (e.g., dynamic capacitance compensation ("DCC"), etc.) for correcting image quality to the image data IMG supplied from the external host processor. In some embodiments, when the controller 150 does not include an algorithm for improving image quality, the image data IMG may be output as the input image data IDATA. The controller 150 may supply the input image data IDATA to the data driver 120.

The controller 150 may generate a data control signal CTLD for controlling an operation of the data driver 120, a gate control signal CTLS for controlling an operation of the gate driver 140, and an emission control signal CTLE for controlling an operation of the emission driver 190 based on the input control signal CON. In an embodiment, the gate control signal CTLS may include a vertical start signal, gate clock signals, or the like, and the data control signal CTLD may include a horizontal start signal, a data clock signal, or the like, for example.

The gate driver 140 may generate data write gate signals GW, data initialization gate signals GI, and compensation gate signals GC based on the gate control signal CTLS received from the controller 150. The gate driver 140 may output the data write gate signals GW, the data initialization gate signals GI, and the compensation gate signals GC to the pixels PX connected to the data write gate lines GWL, the data initialization gate lines GIL, and the compensation gate lines GCL.

The emission driver 190 may generate emission signals EM based on the emission control signal CTLE received from the controller 150. The emission driver 190 may output the emission signals EM to the pixels PX connected to the emission lines EML.

The power supply unit 160 may generate a first initialization voltage VINT, a second initialization voltage VAINT, a first power supply voltage ELVDD, and a second power supply voltage ELVSS, and may provide the first initialization voltage VINT, the second initialization voltage VAINT, the first power supply voltage ELVDD, and the second power supply voltage ELVSS to the pixels PX through the first initialization voltage line VINTL, the second initialization voltage line VAINTL, the first power supply voltage line ELVDDL, and the second power supply voltage line ELVSSL, respectively. In an embodiment, the power supply unit 160 may receive a compensation signal CS from the low frequency offset compensator 130 to apply an offset to the second initialization voltage VAINT.

The data driver 120 may receive the data control signal CTLD and the input image data IDATA from the controller 150. The data driver 120 may convert digital input image data IDATA into an analog data voltage by a gamma reference voltage generated by a gamma reference voltage generator (not shown). In this case, the analog data voltage obtained by the conversion will be defined as a data voltage VDATA. The data driver 120 may output data voltages VDATA to the pixels PX connected to the data lines DL based on the data control signal CTLD. In addition, the data driver 120 may generate a bias power supply voltage VBIAS, and output the bias power supply voltage VBIAS to the pixels PX connected to the data lines DL. In other embodiments, the data driver 120 and the controller 150 may be implemented as a single integrated circuit ("IC"), and such an IC may be also referred to as a timing controller-embedded data driver ("TED").

The low frequency offset compensator 130 may determine whether to apply the offset to the second initialization voltage VAINT when the display panel 110 included in the display device 100 is driven at a low frequency. In order to determine whether to apply the offset to the second initialization voltage VAINT, the low frequency offset compensator 130 may receive the image data IMG, and receive driving frequency information and image data information (or pixel data information) from the image data IMG. The calculator 131 may determine whether the display panel 110 (or the display device 100) is driven at the low frequency based on the image data IMG. When the display panel 110 is driven at the low frequency, the calculator 131 may select display brightness value (hereinafter referred to as "DBV") data corresponding to a current brightness of the display panel (or the display device) among the DBV data stored in the memory 132, and determine a low gray level range of the selected DBV data. In this case, the low gray level range will be defined as being between a lowest gray level value when a brightness of the display panel 110 is about 0.2 nit and a highest gray level value when the brightness of the display panel 110 is 1 nit.

The DBV data may be a luminance value of a light (e.g., a white light) emitted from the pixels PX to correspond to a maximum gray level of the display panel 110, and a unit of a luminance may be nit. An overall brightness of the display panel 110 may vary according to a setting of a user of the display device 100. In an embodiment, the DBV data may include first to $n^{th}$ DBV data, for example. When the display panel 110 is implemented with 0 to 255 gray levels, the first DBV data may signify that the display panel 110 emits a light with 255 gray levels and a brightness of about 2 nits (e.g., a lowest luminance DBV), and the low gray level ranges from 90 (i.e., a lowest gray level) to 187 (i.e., a highest gray level). In addition, when the display panel 110 is implemented with 0 to 255 gray levels, the $n^{th}$ DBV data may signify that the display panel 110 emits a light with 255 gray levels and a brightness of about 1000 nits (e.g., a highest luminance DBV), and the low gray level ranges from 6 (i.e., the lowest gray level) to 11 (i.e., the highest gray level). In this case, the low gray level range may be a criterion for applying the offset to the second initialization voltage VAINT when the display panel 110 is driven at the low frequency. In an embodiment, when the offset of the second initialization voltage VAINT is applied to pixel data exceeding 1 nit, since it is experimentally found that a luminance deviation occurs in the pixel PX, the offset of the second initialization voltage VAINT may be applied to pixel data between about 0.2 nit and about 1 nit, for example.

However, although the low gray level range according to the invention has been defined as being between about 0.2 nit and about 1 nit, the low gray level range is not limited thereto. In an embodiment, the low gray level range may be variously changed depending on a type of the display panel 110, for example.

After the low gray level range of the selected DBV data is determined, the calculator 131 may determine whether the pixel data corresponds within the preset low gray level range based on gray level information included in each of the pixel data. In this case, the pixel data may correspond to pixels arranged in one pixel row, respectively. In an embodiment, when 1440 pixels are arranged in a row direction of the display panel 110, pixel data corresponding to a first pixel row may include first to $1440^{th}$ pixel data, and pixel data corresponding to an $i^{th}$ (i is a natural number) pixel row may also include first to $1440^{th}$ pixel data, for example. In this case, pixel data corresponding to first to $i^{th}$ pixel rows will be defined as frame data.

After the calculator 131 determines whether each of the pixel data corresponds within the preset low gray level range, the calculator 131 may measure a number of pixel data corresponding within the low gray level range with respect to the pixel data corresponding to the first to $i^{th}$ pixel rows.

After the measurement of the number of the pixel data within the low gray level range with respect to the frame data ends, the calculator 131 may determine whether a total number of the pixel data within the low gray level range with respect to the frame data is greater than or equal to a preset number.

When the total number of pixel data within the low gray level range with respect to the frame data is greater than or equal to the preset number, the calculator 131 may determine that the offset is desired to be applied to the second initialization voltage VAINT, and the compensation signal generator 133 may generate the compensation signal CS to provide the generated compensation signal CS to the power supply unit 160.

In addition, after the low gray level range of the selected DBV data is determined, the calculator 131 may determine whether pixel data corresponding to an index pixel (or an index pixel group) is within the low gray level range. In this case, an index pixel may correspond to four pixels selected among pixels overlapping at least four regions selected from each preset pixel row among the first to $i^{th}$ pixel rows. In an embodiment, four pixels selected from one region may be discrete, and 16 pixels may be selected from one pixel row, for example.

In some embodiments, a number of preset pixel rows, a number of regions selected from each preset pixel row, and a number of pixels overlapping each of the selected regions may be variously changed. In addition, the four pixels selected from one region may be consecutive.

In an embodiment, when the number of the pixel data within the low gray level range with respect to the frame data is less than or equal to the preset number, the calculator 131 may determine that it is unnecessary to apply the offset to the second initialization voltage VAINT with respect to the frame data, for example. However, even when the number of the pixel data within the low gray level range with respect to the frame data is less than or equal to the preset number, when pixels corresponding to the pixel data within the low gray level range are clustered in a preset region, a luminance decrease or a luminance increase (i.e., the luminance deviation) may be visually recognized in the clustered pixels (e.g., a low-luminance pattern). Therefore, the calculator 131 may determine whether the pixel data corresponding to the index pixel is within the low gray level range, and when the pixel data corresponding to the index pixel within the low gray level range is greater than or equal to a preset criterion, the calculator 131 may determine that the offset is desired to be applied to the second initialization voltage VAINT, and the compensation signal generator 133 may generate the compensation signal CS to provide the generated compensation signal CS to the power supply unit 160.

Furthermore, after determining whether the pixel data corresponding to the index pixel is within the low gray level range, the calculator 131 may determine whether pixel data corresponding to a window index is within the low gray level range. In this case, a window index pixel may correspond to pixels disposed in a preset region set in each of the first to $i^{th}$ pixel rows. In an embodiment, the window index pixel may include at least four pixels that are adjacent to each other in the row direction in each of the first to $i^{th}$ pixel rows, and the window index pixel may be disposed in a preset region having a quadrangular (e.g., rectangular) shape, for example.

In an embodiment, when the number of the pixel data within the low gray level range with respect to the frame data is less than or equal to the preset number, the calculator 131 may determine that it is unnecessary to apply the offset to the second initialization voltage VAINT with respect to the frame data. However, even when the number of the pixel data within the low gray level range with respect to the frame data is less than or equal to the preset number, when pixels corresponding to the pixel data within the low gray level range are consecutively disposed in a preset region of adjacent pixel rows among the first to $i^{th}$ pixel rows (e.g., in a low-luminance pattern), the luminance deviation may be visually recognized in the pixels disposed in the preset region of the adjacent pixel rows. Therefore, the calculator 131 may determine whether the pixel data corresponding to the window index pixel is within the low gray level range, and when the pixel data corresponding to the window index pixel within the low gray level range is greater than or equal to a preset criterion, the calculator 131 may determine that the offset is desired to be applied to the second initialization voltage VAINT, and the compensation signal generator 133 may generate the compensation signal CS to provide the generated compensation signal CS to the power supply unit 160. In some embodiments, the low frequency offset compensator 130 and the controller 150 may be implemented as a single IC.

Since the display device 100 in the embodiments of the invention includes the low frequency offset compensator 130, when the display panel 110 is driven at a low frequency, the luminance deviation may be prevented from occurring in the pixels PX of the display panel 110 by selectively applying the offset to the second initialization voltage VAINT.

In addition, since the display device 100 selectively applies the offset to the second initialization voltage VAINT, power consumption of the display device 100 may be relatively reduced.

Furthermore, when frame data in which the brightness of the display panel 110 exceeds about 1 nit includes a low-luminance pattern, the display device 100 may apply the offset to the second initialization voltage VAINT so that the luminance deviation that may occur in the pixels PX of the display panel 110 may be reduced.

Figure 3:
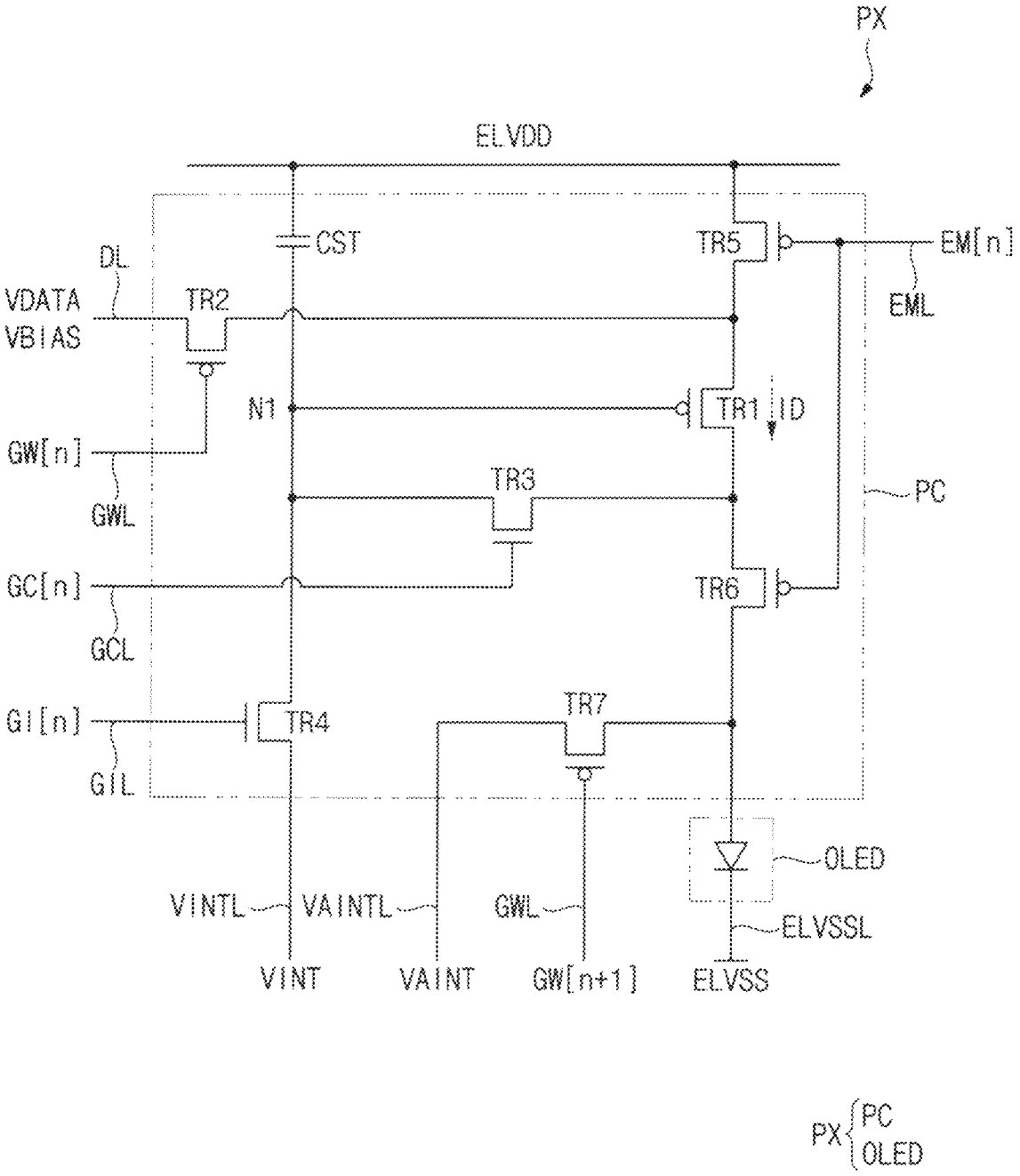
FIG. 3 is a circuit diagram showing a pixel included in the display device of FIG. 1.
Figure 4:
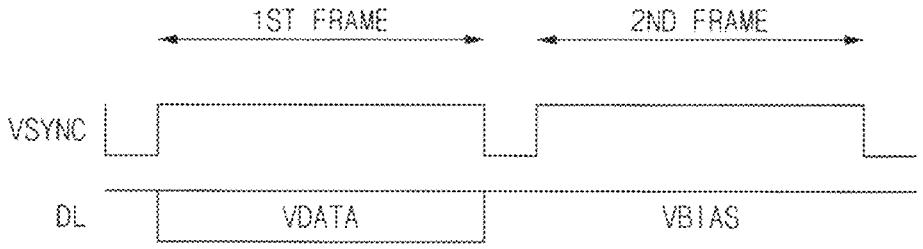
FIG. 4 is a timing diagram for describing that a data voltage and a bias power supply voltage are applied to a data line during low-frequency driving.

FIG. 3 is a circuit diagram showing a pixel included in the display device of FIG. 1, and FIG. 4 is a timing diagram for describing that a data voltage and a bias power supply voltage are applied to a data line during low-frequency driving.

Referring to FIGS. 3 and 4, the display device 100 may include a pixel PX, and the pixel PX may include a pixel circuit PC and an organic light-emitting diode OLED. In this case, the pixel circuit PC may include first to seventh transistors TR1, TR2, TR3, TR4, TR5, TR6, and TR7, a storage capacitor CST, or the like. In addition, the pixel circuit PC or the organic light-emitting diode OLED may be connected to the first power supply voltage line ELVDDL, the second power supply voltage line ELVSSL, the first initialization voltage line VINTL, the second initialization voltage line VAINTL, the data line DL, the data write gate line GWL, the data initialization gate line GIL, the compensation gate line GCL, the emission line EML, or the like. The first transistor TR1 may correspond to a driving transistor, and the second to seventh transistors TR2, TR3, TR4, TR5, TR6, and TR7 may correspond to switching transistors. Each of the first to seventh transistors TR1, TR2, TR3, TR4, TR5, TR6, and TR7 may include a first terminal, a second terminal, and a gate terminal. In an embodiment, the first terminal may be a source terminal, and the second terminal may be a drain terminal. In some embodiments, the first terminal may be a drain terminal, and the second terminal may be a source terminal.

In an embodiment, each of the first, second, fifth, sixth, and seventh transistors TR1, TR2, TR5, TR6, and TR7 may be a p-channel metal-oxide-semiconductor ("PMOS") transistor, and may have a channel including polysilicon. In addition, each of the third and fourth transistors TR3 and TR4 may be an n-channel metal-oxide-semiconductor ("NMOS") transistor, and may have a channel including a metal oxide semiconductor.

The organic light-emitting diode OLED may output a light based on a driving current ID. The organic light-emitting diode OLED may include a first terminal and a second terminal. In an embodiment, the first terminal of the organic light-emitting diode OLED may receive the first power supply voltage ELVDD, and the second terminal of the organic light-emitting diode OLED may receive the second power supply voltage ELVSS. In this case, the first power supply voltage ELVDD and the second power supply voltage ELVSS may be provided from the power supply unit 160 through the first power supply voltage line ELVDDL and the second power supply voltage line ELVSSL, respectively. In an embodiment, the first terminal of the organic light-emitting diode OLED may be an anode terminal, and the second terminal of the organic light-emitting diode OLED may be a cathode terminal, for example. In some embodiments, the first terminal of the organic light-emitting diode OLED may be a cathode terminal, and the second terminal of the organic light-emitting diode OLED may be an anode terminal.

The first power supply voltage ELVDD may be applied to the first terminal of the first transistor TR1. The second terminal of the first transistor TR1 may be connected to the first terminal of the organic light-emitting diode OLED. The first initialization voltage VINT may be applied to the gate terminal of the first transistor TR1. In this case, the first initialization voltage VINT may be provided from the power supply unit 160 through the first initialization voltage line VINTL.

The first transistor TR1 may generate the driving current ID. In an embodiment, the first transistor TR1 may operate in a saturation region. In this case, the first transistor TR1 may generate the driving current ID based on a voltage difference between the gate terminal and the first terminal (e.g., source terminal) of the first transistor TR1. In addition, gray levels may be expressed based on a magnitude of the driving current ID supplied to the organic light-emitting diode OLED. In some embodiments, the first transistor TR1 may operate in a linear region. In this case, the gray levels may be expressed based on a sum of a time during which the driving current is supplied to the organic light-emitting diode OLED within one frame.

The gate terminal of the second transistor TR2 may receive a data write gate signal GW[n] (n is a natural number). In this case, the data write gate signal GW[n] may be provided from the gate driver 140 through the data write gate line GWL. The first terminal of the second transistor TR2 may receive the data voltage VDATA and the bias power supply voltage VBIAS. In this case, the data voltage VDATA and the bias power supply voltage VBIAS may be provided from the data driver 120 through the data line DL. The second terminal of the second transistor TR2 may be connected to the first terminal of the first transistor TR1. In an embodiment, when the display panel 110 is driven at the low frequency, as shown in FIG. 4, the data voltage VDATA and the bias power supply voltage VBIAS may be alternately provided to the second transistor TR2 for each frame through the data line DL, and the data voltage VDATA and the bias power supply voltage VBIAS may be supplied to the first terminal (e.g., source terminal) of the first transistor TR1 during an activation period of the data write gate signal GW[n], for example. In this case, the second transistor TR2 may operate in a linear region.

Referring back to FIG. 3, the gate terminal of the third transistor TR3 may receive a compensation gate signal GC[n]. In this case, the compensation gate signal GC[n] may be provided from the gate driver 140 through the compensation gate line GCL. The first terminal of the third transistor TR3 may be connected to the gate terminal of the first transistor TR1. The second terminal of the third transistor TR3 may be connected to the second terminal of the first transistor TR1. In other words, the third transistor TR3 may be connected between the gate terminal of the first transistor TR1 and the second terminal of the first transistor TR1.

The third transistor TR3 may connect the gate terminal of the first transistor TR1 to the second terminal of the first transistor TR1 during an activation period of the compensation gate signal GC[n]. In this case, the third transistor TR3 may operate in a linear region. That is, the third transistor TR3 may diode-connect the first transistor TR1 during the activation period of the compensation gate signal GC[n]. In other words, the third transistor TR3 may diode-connect the first transistor TR1 in response to the compensation gate signal GC[n]. Since the first transistor TR1 is diode-connected, a voltage difference corresponding to a threshold voltage of the first transistor TR1 may occur between the first terminal of the first transistor TR1 and the gate terminal of the first transistor TR1. In this case, the threshold voltage may have a negative value. As a result, a voltage obtained by summing up the data voltage VDATA supplied to the first terminal of the first transistor TR1 and the voltage difference (i.e., the threshold voltage) may be supplied to the gate terminal of the first transistor TR1 during the activation period of the data write gate signal GW[n]. In other words, the data voltage VDATA may be compensated for by the threshold voltage of the first transistor TR1, and the compensated data voltage VDATA may be supplied to the gate terminal of the first transistor TR1.

In an embodiment, the third transistor TR3 may include an NMOS transistor as described above, and the NMOS transistor may relatively reduce a leakage current. In an embodiment, when the leakage current is generated in the third transistor TR3, a voltage of the gate terminal of the first transistor TR1 may be increased, and the driving current ID may be decreased, so that a luminance may be decreased, for example. Accordingly, when the display device 100 is driven at the low frequency, in order to reduce the leakage current of the third transistor TR3 in a high gray level, the third transistor TR3 may be configured as the NMOS transistor.

The gate terminal of the fourth transistor TR4 (e.g., a second switching transistor) may receive a data initialization gate signal GI[n]. In this case, the data initialization gate signal GI[n] may be provided from the gate driver 140 through the data initialization gate line GIL. The first terminal of the fourth transistor TR4 may receive the first initialization voltage VINT. The second terminal of the fourth transistor TR4 may be connected to the gate terminal of the first transistor TR1 (or the first terminal of the third transistor TR3).

The fourth transistor TR4 may supply the first initialization voltage VINT to the gate terminal of the first transistor TR1 during an activation period of the data initialization gate signal GI[n]. In this case, the fourth transistor TR4 may operate in a linear region. In other words, the fourth transistor TR4 may initialize the gate terminal of the first transistor TR1 to the first initialization voltage VINT during the activation period of the data initialization gate signal GI[n]. In an embodiment, the first initialization voltage VINT may have a voltage level that is sufficiently lower than a voltage level of the data voltage VDATA maintained by the storage capacitor CST in a previous frame, and the first initialization voltage VINT may be supplied to the gate terminal of the first transistor TR1. In other embodiments, the first initialization voltage VINT may have a voltage level that is sufficiently higher than the voltage level of the data voltage VDATA maintained by the storage capacitor CST in the previous frame, and the first initialization voltage VINT may be supplied to the gate terminal of the first transistor TR1.

The fourth transistor TR4 may include an NMOS transistor as described above, and the NMOS transistor may relatively reduce a leakage current. In an embodiment, when the leakage current is generated in the fourth transistor TR4, the voltage of the gate terminal of the first transistor TR1 may be increased, and the driving current ID may be decreased, so that the luminance may be decreased, for example. Accordingly, when the display device 100 is driven at the low frequency, in order to reduce the leakage current of the fourth transistor TR4 in a high gray level, the fourth transistor TR4 may be configured as the NMOS transistor.

The gate terminal of the fifth transistor TR5 may receive an emission signal EM[n]. In this case, the emission signal EM[n] may be provided from the emission driver 190 through the emission line EML. The first terminal of the fifth transistor TR5 may receive the first power supply voltage ELVDD. The second terminal of the fifth transistor TR5 may be connected to the first terminal of the first transistor TR1. The fifth transistor TR5 may supply the first power supply voltage ELVDD to the first terminal of the first transistor TR1 during an activation period of the emission signal EM[n]. On the contrary, the fifth transistor TR5 may cut off the supply of the first power supply voltage ELVDD during an inactivation period of the emission signal EM[n]. In this case, the fifth transistor TR5 may operate in a linear region. Since the fifth transistor TR5 supplies the first power supply voltage ELVDD to the first terminal of the first transistor TR1 during the activation period of the emission signal EM[n], the first transistor TR1 may generate the driving current ID. In addition, since the fifth transistor TR5 cuts off the supply of the first power supply voltage ELVDD during the inactivation period of the emission signal EM[n], the data voltage VDATA supplied to the first terminal of the first transistor TR1 may be supplied to the gate terminal of the first transistor TR1.

The gate terminal of the sixth transistor TR6 may receive the emission signal EM[n]. The first terminal of the sixth transistor TR6 may be connected to the second terminal of the first transistor TR1. The second terminal of the sixth transistor TR6 may be connected to the first terminal of the organic light-emitting diode OLED. The sixth transistor TR6 may supply the driving current ID generated by the first transistor TR1 to the organic light-emitting diode OLED during the activation period of the emission signal EM[n]. In this case, the sixth transistor TR6 may operate in a linear region. In other words, when the sixth transistor TR6 supplies the driving current ID generated by the first transistor TR1 to the organic light-emitting diode OLED during the activation period of the emission signal EM[n], the organic light-emitting diode OLED may output the light. In addition, when the sixth transistor TR6 electrically separates the first transistor TR1 and the organic light-emitting diode OLED from each other during the inactivation period of the emission signal EM[n], the compensated data voltage VDATA supplied to the second terminal of the first transistor TR1 may be supplied to the gate terminal of the first transistor TR1.

The gate terminal of the seventh transistor TR7 (e.g., a first switching transistor) may receive a data write gate signal GW[n+1]. The first terminal of the seventh transistor TR7 may receive the second initialization voltage VAINT. The second terminal of the seventh transistor TR7 may be connected to the first terminal of the organic light-emitting diode OLED. The seventh transistor TR7 may supply the second initialization voltage VAINT to the first terminal of the organic light-emitting diode OLED during an activation period of the data write gate signal GW[n+1]. In this case, the seventh transistor TR7 may operate in a linear region. In other words, the seventh transistor TR7 may initialize the first terminal of the organic light-emitting diode OLED to the second initialization voltage VAINT during the activation period of the data write gate signal GW[n+1]. In some embodiments, the data write gate signal GW[n+1] may be substantially the same as the data write gate signal GW[n] of one horizontal time before.

The storage capacitor CST may be connected between the first power supply voltage line ELVDDL and the gate terminal of the first transistor TR1. The storage capacitor CST may include a first terminal and a second terminal. In an embodiment, the first terminal of the storage capacitor CST may receive the first power supply voltage ELVDD, and the second terminal of the storage capacitor CST may be connected to the gate terminal of the first transistor TR1, for example. The storage capacitor CST may maintain the voltage level of the gate terminal of the first transistor TR1 during an inactivation period of the data write gate signal GW[n]. The inactivation period of the data write gate signal GW[n] may overlap and be greater than an entirety of the activation period of the emission signal EM[n], and the driving current ID generated by the first transistor TR1 may be supplied to the organic light-emitting diode OLED during the activation period of the emission signal EM[n]. Therefore, the driving current ID generated by the first transistor TR1 may be supplied to the organic light-emitting diode OLED based on the voltage level maintained by the storage capacitor CST.

However, although the pixel circuit PC according to the invention has been described as including one driving transistor, six switching transistors, and one storage capacitor, the configuration of the invention is not limited thereto. In an embodiment, the pixel circuit PC may have a configuration including at least one driving transistor, at least one switching transistor, and at least one storage capacitor, for example.

In addition, although the light-emitting element included in the pixel PX according to the invention has been described as including the organic light-emitting diode OLED, the configuration of the invention is not limited thereto. In an embodiment, the light-emitting element may include a quantum dot ("QD") light-emitting element, an inorganic light-emitting diode, or the like, for example.

Figure 5:
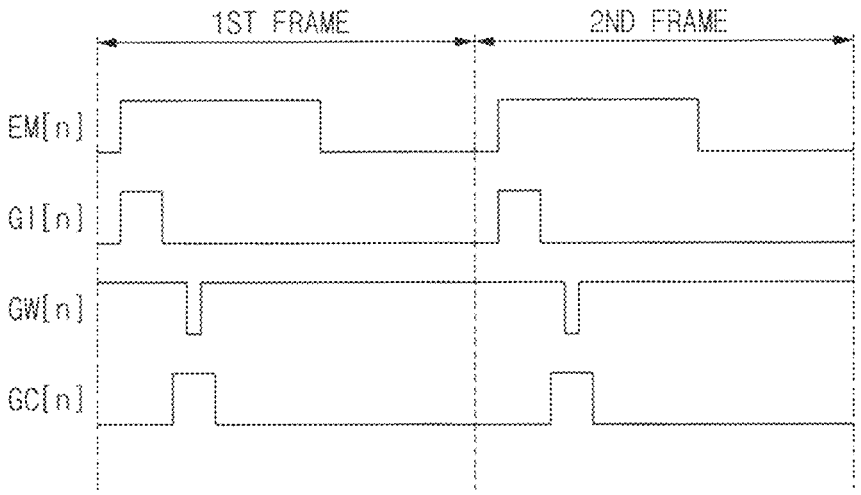
FIGS. 5 and 6 are timing diagrams for describing signals for driving the pixel of FIG. 3.
Figure 6:
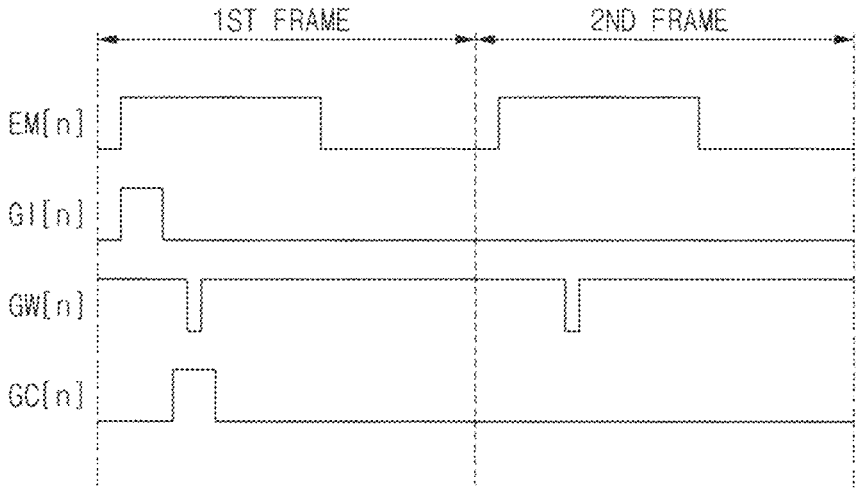
Figure 7:
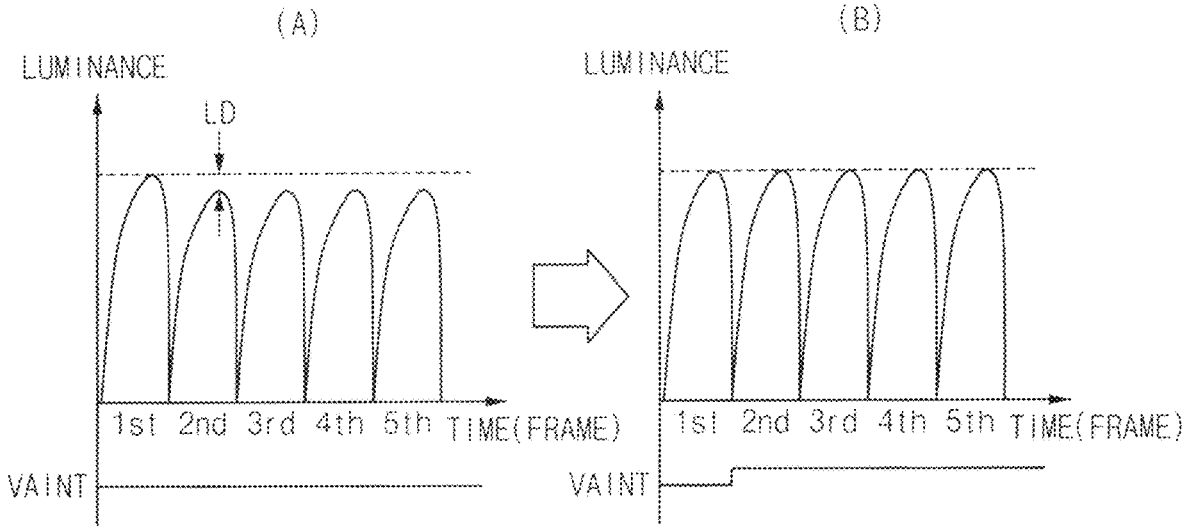
FIG. 7 is a view for describing offset compensation of a second initialization voltage included in the pixel of FIG. 3.

FIGS. 5 and 6 are timing diagrams for describing signals for driving the pixel of FIG. 3, and FIG. 7 is a view for describing offset compensation of a second initialization voltage included in the pixel of FIG. 3. In an embodiment, FIG. 5 is a timing diagram showing signals applied to the pixel PX when the display panel 110 is driven at a high frequency, and FIG. 6 is a timing diagram showing signals applied to the pixel PX when the display panel 110 is driven at a low frequency, for example.

Referring to FIG. 5, in first and second frames, the inactivation period (e.g., a logic high level period) of the emission signal EM[n] may overlap the activation period of each of the data initialization gate signal GI[n], the data write gate signal GW[n], and the compensation gate signal GC[n].

When the inactivation period of the emission signal EM[n] starts after the activation period (e.g., a logic low level period) of the emission signal EM[n] ends, the activation period (e.g., a logic high level period) of the data initialization gate signal GI[n] may start. As shown in FIG. 3, the fourth transistor TR4 may be turned on during the logic high level period of the data initialization gate signal GI[n], and a current may flow out from the gate terminal of the first transistor TR1 to the first initialization voltage line VINTL. In other words, during the activation period of the data initialization gate signal GI[n], the gate terminal of the first transistor TR1 may be initialized to the first initialization voltage VINT.

After the activation period of the data initialization gate signal GI[n] ends, the activation period of the data write gate signal GW[n] and the activation period of the compensation gate signal GC[n] may be arranged. In an embodiment, after the activation period of the data initialization gate signal GI[n] ends, the activation period (e.g., a logic high level period) of the compensation gate signal GC[n] may start, and an entirety of the activation period of the data write gate signal GW[n] may overlap and be less than the activation period of the compensation gate signal GC[n], for example.

During the activation period (e.g., a logic low level period) of the data write gate signal GW[n], the second transistor TR2 may be turned on, and may provide the data voltage VDATA to the second terminal of the first transistor TR1 in the first frame. In addition, during the activation period of the data write gate signal GW[n], the second transistor TR2 may provide the bias power supply voltage VBIAS to the first terminal of the first transistor TR1 in the second frame. In this case, the first transistor TR1 may be in an on-bias state.

During the activation period (e.g., the logic high level period) of the compensation gate signal GC[n], the third transistor TR3 may be turned on, and may provide the data voltage VDATA, which is provided to the second terminal of the first transistor TR1, to the gate terminal of the first transistor TR1 in the first frame.

When the display panel 110 is driven at a high frequency, during the activation period of the data initialization gate signal GI[n], due to a capacitor generated by the data initialization gate line GIL and the first terminal (i.e., the anode terminal) of the organic light-emitting diode OLED, the organic light-emitting diode OLED may emit a light (e.g., ripple light emission). In this case, the luminance decrease or the luminance increase (i.e., the luminance deviation) of the organic light-emitting diode OLED may not occur in the display panel 110, and it is unnecessary to apply the offset to the second initialization voltage VAINT for initializing the first terminal of the organic light-emitting diode OLED.

Referring to FIGS. 6 and 7, the inactivation period of the emission signal EM[n] in the first frame may overlap the activation period of each of the data initialization gate signal GI[n], the data write gate signal GW[n], and the compensation gate signal GC[n], and the inactivation period of the emission signal EM[n] in the second frame may overlap the activation period of the data write gate signal GW[n]. In other words, when the display panel 110 is driven at the low frequency, the data initialization gate signal GI[n] and the compensation gate signal GC[n] may not be activated in the second frame. In this case, since the capacitor is not generated by the data initialization gate line GIL and the first terminal of the organic light-emitting diode OLED, the organic light-emitting diode OLED may not emit the light, and the luminance of the organic light-emitting diode OLED may be decreased after a start of the second frame as shown in FIG. 7. In other words, a luminance deviation LD may occur in the pixels PX included in the display panel 110 after a start of the second frame. The offset may be applied to the second initialization voltage VAINT to compensate for the reduced luminance of the organic light-emitting diode OLED after the second frame. Accordingly, a voltage level of the second initialization voltage VAINT may be increased after the second frame, so that the luminance deviation LD of the organic light-emitting diode OLED may be prevented.

Figure 8:
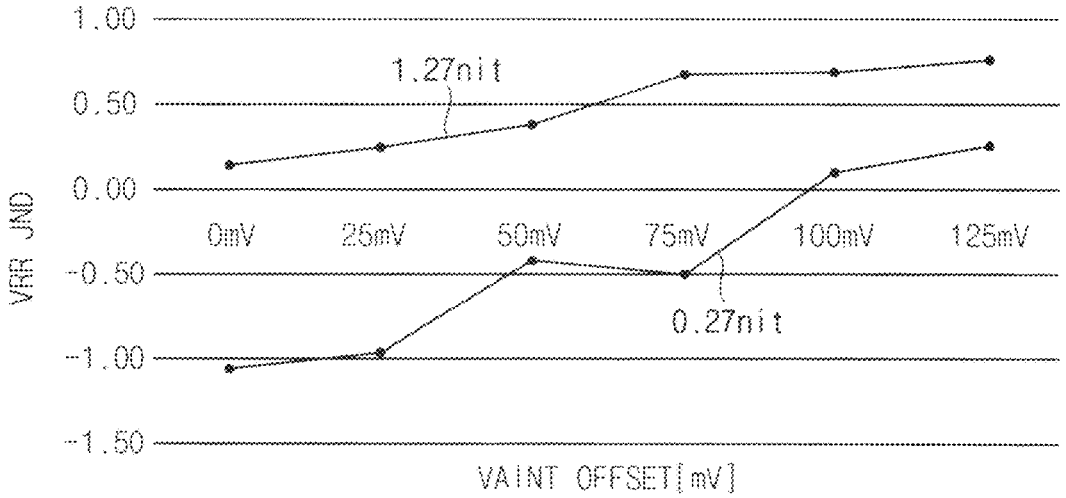
FIG. 8 is a view for describing a luminance deviation occurring at a specific luminance after offset compensation is performed on the second initialization voltage applied to the pixel of FIG. 3.

FIG. 8 is a view for describing a luminance deviation occurring at a specific luminance after offset compensation is performed on the second initialization voltage applied to the pixel of FIG. 3. In an embodiment, as shown in a graph of FIG. 8, a horizontal axis may represent a voltage magnitude of the offset applied to the second initialization voltage VAINT, and a vertical axis may represent that the luminance deviation (indicated as "VRR JND" in FIG. 8) does not occur in the display panel 110 as it approaches 0, for example. In an embodiment, 0 millivolt (mV) on the horizontal axis may represent that an offset voltage is not applied to the second initialization voltage VAINT, and 125 mV on the horizontal axis may represent that an offset voltage of 125 mV is applied to the second initialization voltage VAINT, for example.

Referring to FIG. 8, Graph 1 located on an upper side may be a graph in which the brightness of the display panel 110 corresponds to about 1.27 nits when the display panel 110 is driven at a low frequency. Graph 2 located on a lower side may be a graph in which the brightness of the display panel 110 corresponds to about 0.27 nit when the display panel 110 is driven at a low frequency.

In Graph 1, it has been shown that substantially no luminance deviation occurs when the offset of the second initialization voltage VAINT is not applied (e.g., 0 mV), and the luminance deviation is gradually increased as the offset voltage of the second initialization voltage VAINT increases.

In Graph 2, it has been shown that substantially no luminance deviation occurs when the offset voltage of the second initialization voltage VAINT is 100 mV.

Experimentally, when the display panel 110 is driven at the low frequency, and the brightness of the display panel 110 is 1.27 nits, no offset voltage is desired to be applied to the second initialization voltage VAINT; and when the display panel 110 is driven at the low frequency, and the brightness of the display panel 110 is 0.27 nit, the offset voltage is desired to be applied to the second initialization voltage VAINT.

Accordingly, in the embodiments of the invention, the low gray level range may be defined as being between the lowest gray level value when the brightness of the display panel 110 is about 0.2 nit and the highest gray level value when the brightness of the display panel 110 is about 1 nit. In other words, the pixel data exceeding about 1 nit may be excluded from the application of the offset of the second initialization voltage VAINT.

Figure 9:
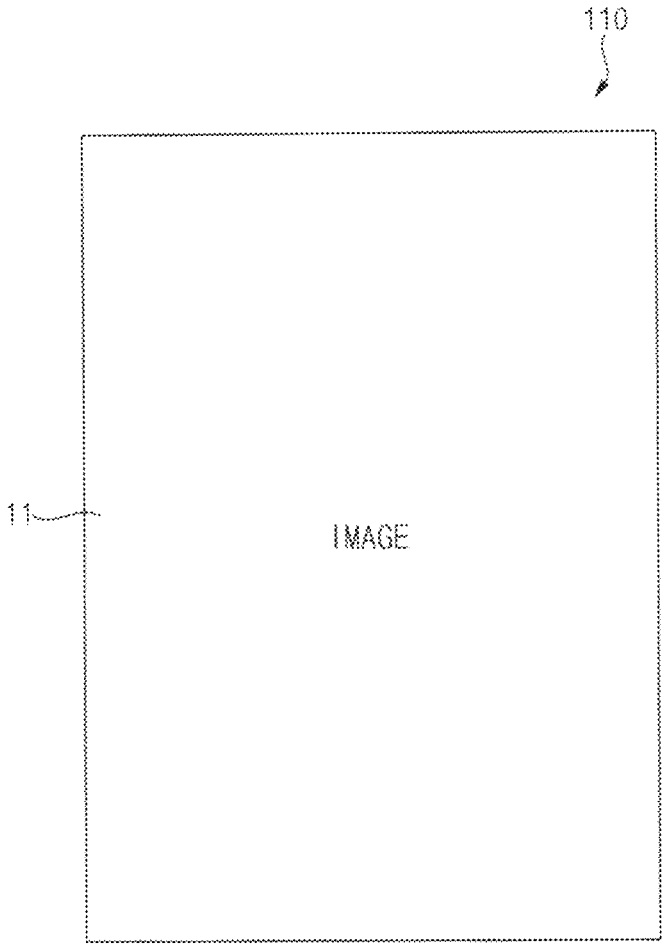
FIG. 9 is a block diagram showing an embodiment of a method of driving a display device according to the invention.
Figure 10:
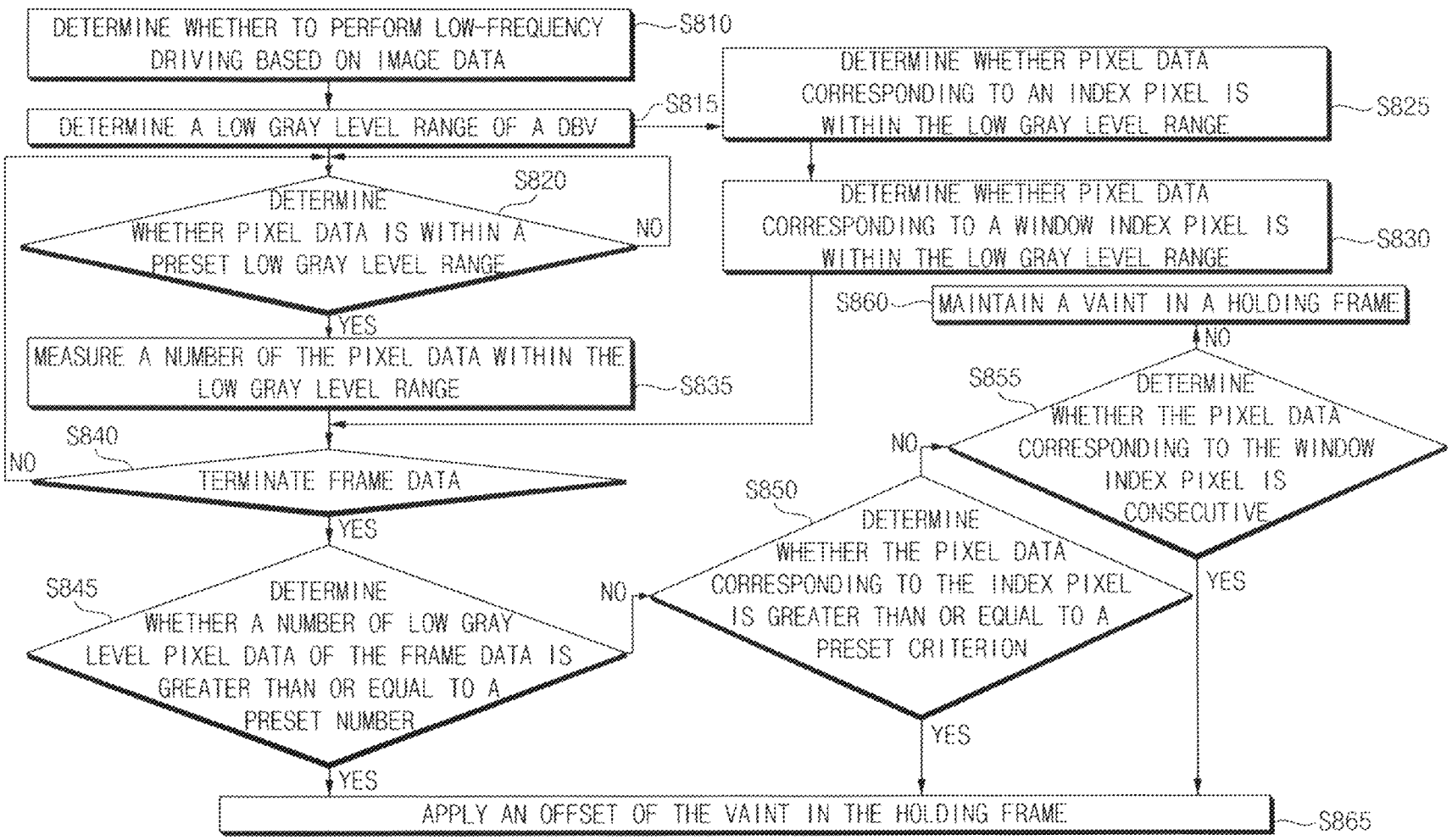
FIG. 10 is a flowchart showing the method of driving the display device of FIG. 9.
Figure 15:
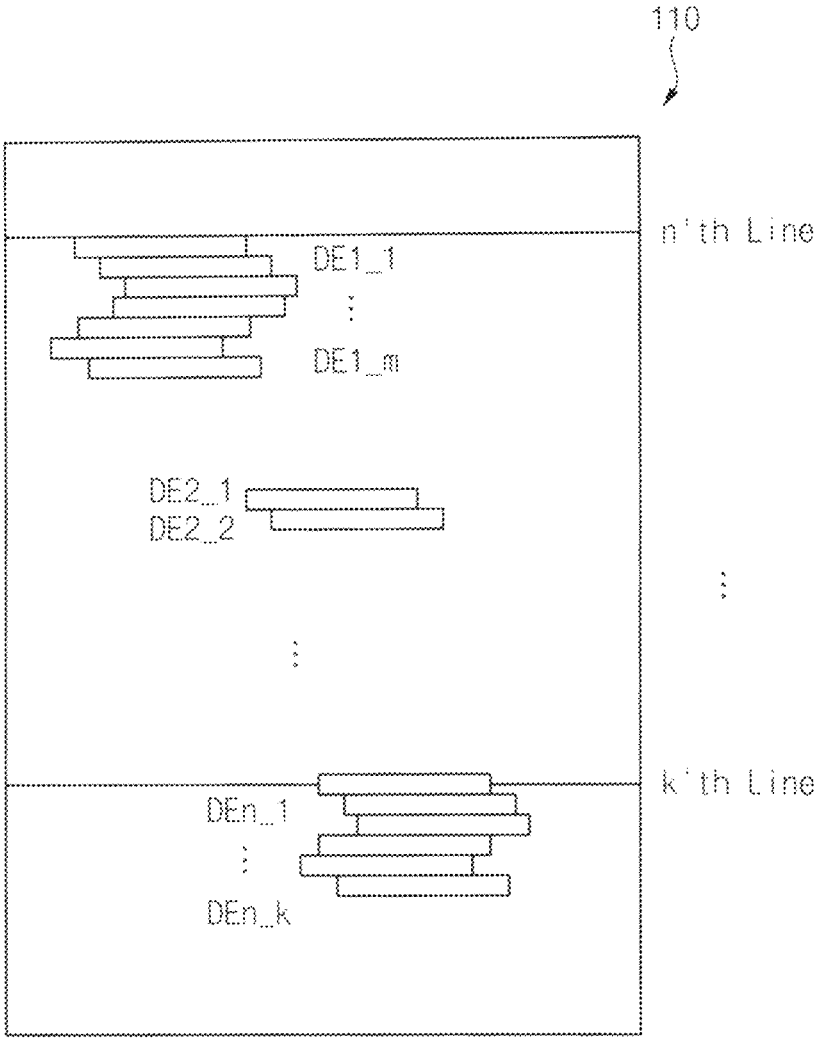
Figure 16:
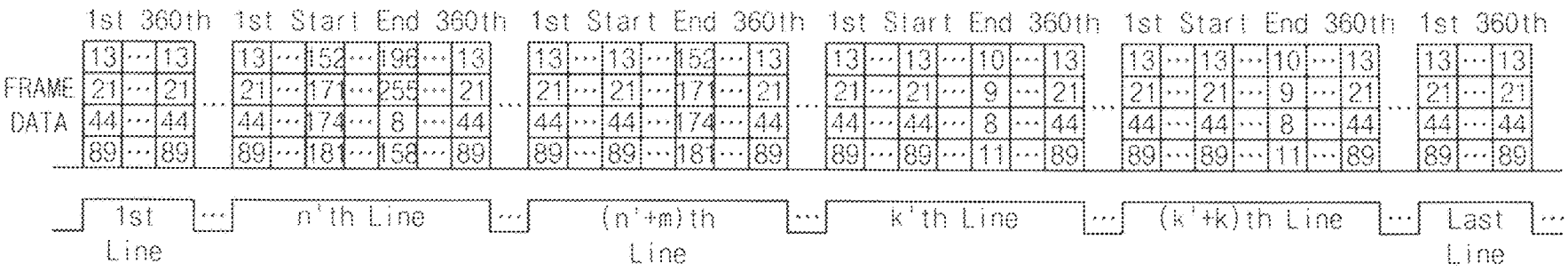
Figure 17:
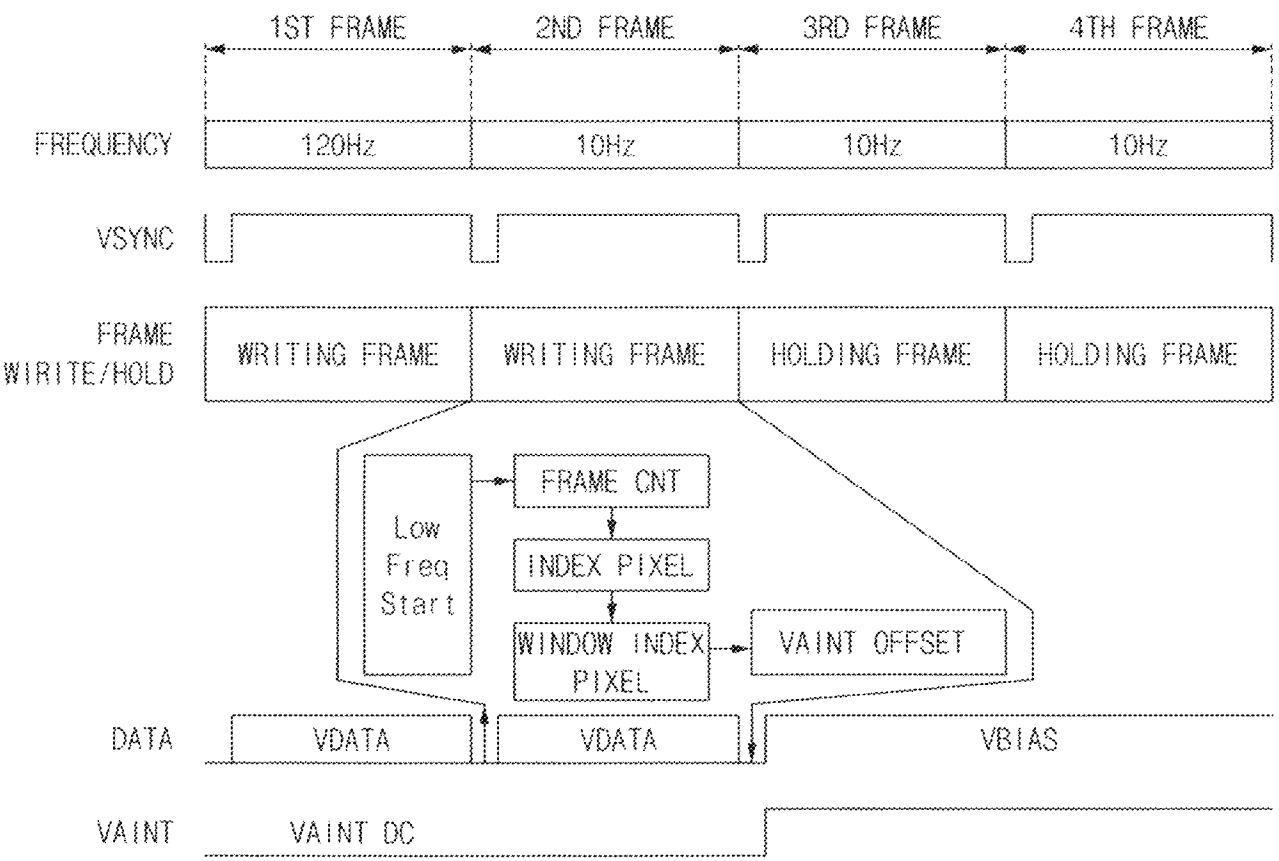
FIG. 17 is a timing diagram for describing the method of driving the display device of FIG. 10.

FIG. 9 is a block diagram showing a method of driving a display device in embodiments of the invention, FIG. 10 is a flowchart showing the method of driving the display device of FIG. 9, FIGS. 11, 12, 13, 14, 15, and 16 are views for describing the method of driving the display device of FIG. 10, and FIG. 17 is a timing diagram for describing the method of driving the display device of FIG. 10. In an embodiment, the display panel 110 shown in FIG. 9 may correspond to the display panel 110 shown in FIG. 1, for example.

Referring to FIG. 10, a method of driving a display device may include: determining whether to perform low-frequency driving based on image data (S810); determining a low gray level range of a DBV (S815); determining whether pixel data is within a preset low gray level range (S820); determining whether pixel data corresponding to an index pixel is within the low gray level range (S825); determining whether pixel data corresponding to a window index pixel is within the low gray level range (S830); measuring a number of the pixel data within the low gray level range (S835); terminating frame data (S840); determining whether a number of low gray level pixel data of the frame data is greater than or equal to a preset number (S845); determining whether the pixel data corresponding to the index pixel is greater than or equal to a preset criterion (S850); determining whether the pixel data corresponding to the window index pixel is consecutive (S855); maintaining a second initialization voltage in a holding frame (S860); and applying an offset of the second initialization voltage in the holding frame (S865).

Referring to FIGS. 1, 9, and 17, the display panel 110 may include a display area 11, and an image may be displayed in the display area 11.

As shown in FIG. 17, in the first frame, the display panel 110 may be driven at 120 hertz (Hz) (e.g., a high frequency), the first frame may correspond to a data write period, the data voltage VDATA may be provided to the pixel PX, and the offset may not be applied to the second initialization voltage VAINT.

Referring to FIGS. 1, 2, 9, and 10, the low frequency offset compensator 130 may receive the image data IMG, and receive the driving frequency information and the image data information (or the pixel data information) from the image data IMG. The calculator 131 may determine whether the display panel 110 (or the display device 100) is driven at the low frequency based on the image data IMG.

Referring to FIGS. 2, 10, 11, and 17, when the display panel 110 is driven at the low frequency, the calculator 131 may select DBV data corresponding to a current brightness of the display panel (or the display device) among the DBV data stored in the memory 132, and determine a low gray level range of the selected DBV data. As shown in FIG. 11, the low gray level range will be defined as being between a lowest gray level value when a brightness of the display panel 110 is about 0.2 nit and a highest gray level value when the brightness of the display panel 110 is about 1 nit.

The DBV data may be a luminance value of a light (e.g., a white light) emitted from the pixels PX to correspond to a maximum gray level of the display panel 110, and a unit of a luminance may be nit. An overall brightness of the display panel 110 may vary according to a setting of a user of the display device 100. In an embodiment, the DBV data may include first to $n^{th}$ DBV data, for example. When the display panel 110 is implemented with 0 to 255 gray levels, the first DBV data may signify that the display panel 110 emits a light with 255 gray levels and a brightness of about 2 nits (e.g., a lowest luminance DBV), and the low gray level ranges from 90 (i.e., a lowest gray level) to 187 (i.e., a highest gray level). In addition, when the display panel 110 is implemented with 0 to 255 gray levels, the $n^{th}$ DBV data may signify that the display panel 110 emits a light with 255 gray levels and a brightness of about 1000 nits (e.g., a highest luminance DBV), and the low gray level ranges from 6 (i.e., the lowest gray level) to 11 (i.e., the highest gray level). In this case, the low gray level range may be a criterion for applying the offset to the second initialization voltage VAINT when the display panel 110 is driven at the low frequency. In an embodiment, when the offset of the second initialization voltage VAINT is applied to pixel data exceeding 1 nit, since it is experimentally found that a luminance deviation occurs in the pixel PX, the offset of the second initialization voltage VAINT may be applied to pixel data between about 0.2 nit and about 1 nit, for example.

As shown in FIG. 17, in the second frame, the display panel 110 may be driven at 10 Hz (e.g., a low frequency), the second frame may correspond to the data write period, the data voltage VDATA may be provided to the pixel PX, and the offset may not be applied to the second initialization voltage VAINT. In an embodiment, the calculator 131 may determine whether the display panel 110 is driven at a low frequency based on the image data IMG during a porch period (e.g., a period desired for adjusting synchronization between frames) of a vertical synchronization signal VSYNC in the second frame, and when the display panel 110 is driven at the low frequency, the calculator 131 may recognize the low-frequency driving of the display panel 110.

Referring to FIGS. 2, 10, 11, and 12, after the low gray level range of the selected DBV data is determined, the calculator 131 may determine whether the pixel data corresponds within the preset low gray level range based on gray level information included in each of the pixel data. In this case, the pixel data may correspond to pixels arranged in one pixel row, respectively. In an embodiment, when 1440 pixels are arranged in a row direction of the display panel 110, pixel data corresponding to a first pixel row may include first to $1440^{th}$ pixel data, and pixel data corresponding to an $i^{th}$ pixel row may also include first to $1440^{th}$ pixel data, for example. In this case, pixel data corresponding to first to $i^{th}$ pixel rows will be defined as frame data.

After the calculator 131 determines whether each of the pixel data corresponds within the preset low gray level range, the calculator 131 may measure a number of pixel data corresponding within the low gray level range with respect to the pixel data corresponding to the first to $i^{th}$ pixel rows.

Figure 12:
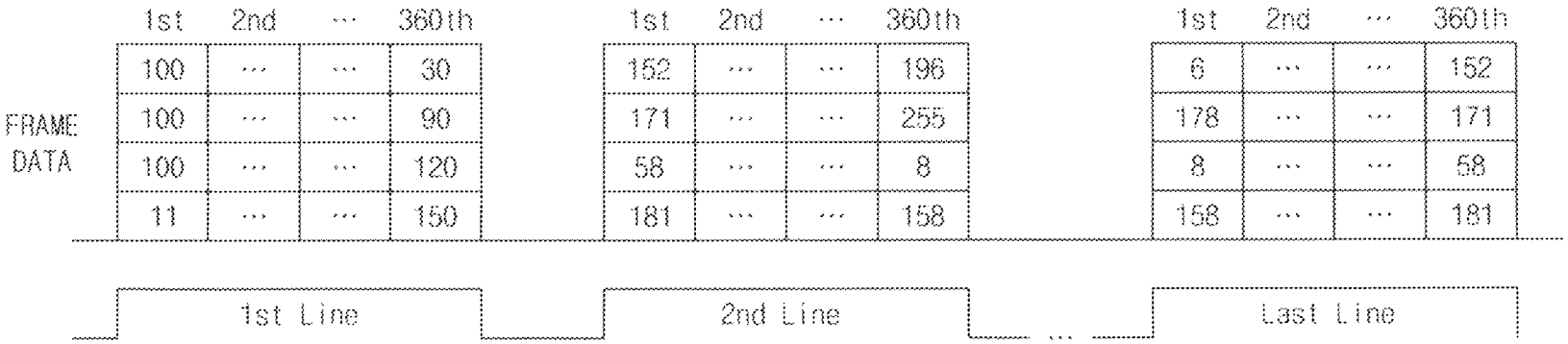

As shown in FIG. 12, the frame data including the pixel data corresponding to the first to $i^{th}$ pixel rows may be provided to the calculator 131 based on a clock signal, and the calculator 131 may determine whether each of the pixel data corresponds within the preset low gray level range. In addition, the calculator 131 may measure the number of the pixel data corresponding to the first to $i^{th}$ pixel rows within the low gray level range with respect to the pixel data corresponding to the first to $i^{th}$ pixel rows, and the calculator 131 may store the measured number in the memory 132. In an embodiment, the number of the pixel data corresponding to the low gray level range may be measured for each pixel row, and when the number of the pixel data corresponding to the low gray level range is measured in the $i^{th}$ pixel row, the total number of the pixel data corresponding within the low gray level range with respect to the frame data may be stored in the memory 132, for example. In some embodiments, there may be a delay by one clock signal in a process of storing the number of the pixel data corresponding within the low gray level range in the memory 132.

In addition, the pixel data of FIG. 12 may correspond to red pixel data, and the same process may be performed for green pixel data and blue pixel data.

After the above process is completely performed, the frame data may be terminated (or the measurement of the total number of the pixel data corresponding within the low gray level range with respect to the frame data may be terminated).

Referring to FIGS. 1, 2, 10, and 17, after the measurement of the number of the pixel data within the low gray level range with respect to the frame data ends, the calculator 131 may determine whether a total number of the pixel data within the low gray level range with respect to the frame data is greater than or equal to a preset number.

When the total number of pixel data within the low gray level range with respect to the frame data is greater than or equal to the preset number, the calculator 131 may determine that the offset is desired to be applied to the second initialization voltage VAINT, and the compensation signal generator 133 may generate the compensation signal CS to provide the generated compensation signal CS to the power supply unit 160. The power supply unit 160 may receive a compensation signal CS from the low frequency offset compensator 130 to apply an offset to the second initialization voltage VAINT. In other words, only when the display panel 110 is driven at the low frequency, and the image displayed in the display area 11 has a low luminance, the display device 100 may apply the offset to the second initialization voltage VAINT.

As shown in FIG. 17, in the third frame, the display panel 110 may be driven at 10 Hz, the third frame may correspond to a holding frame period, the bias power supply voltage VBIAS may be provided to the pixel PX, and the offset may be applied to the second initialization voltage VAINT. In an embodiment, the calculator 131 may determine that the offset is desired to be applied to the second initialization voltage VAINT during the porch period of the vertical synchronization signal VSYNC in the third frame, the compensation signal generator 133 may generate the compensation signal CS to provide the generated compensation signal CS to the power supply unit 160, and the power supply unit 160 may receive the compensation signal CS from the low frequency offset compensator 130 to apply the offset to the second initialization voltage VAINT. In addition, after the porch period in the third frame, the power supply unit 160 may receive the compensation signal CS from the low frequency offset compensator 130 to apply the offset to the second initialization voltage VAINT.

Referring to FIGS. 2, 10, 13, and 14, after the low gray level range of the selected DBV data is determined, the calculator 131 may determine whether pixel data corresponding to an index pixel (or an index pixel group) is within the low gray level range. In this case, an index pixel may correspond to four pixels selected among pixels overlapping at least four regions selected from each preset pixel row among the first to $i^{th}$ pixel rows. In an embodiment, four pixels selected from one region may be discrete, and 16 pixels may be selected from one pixel row, for example.

Figure 13:
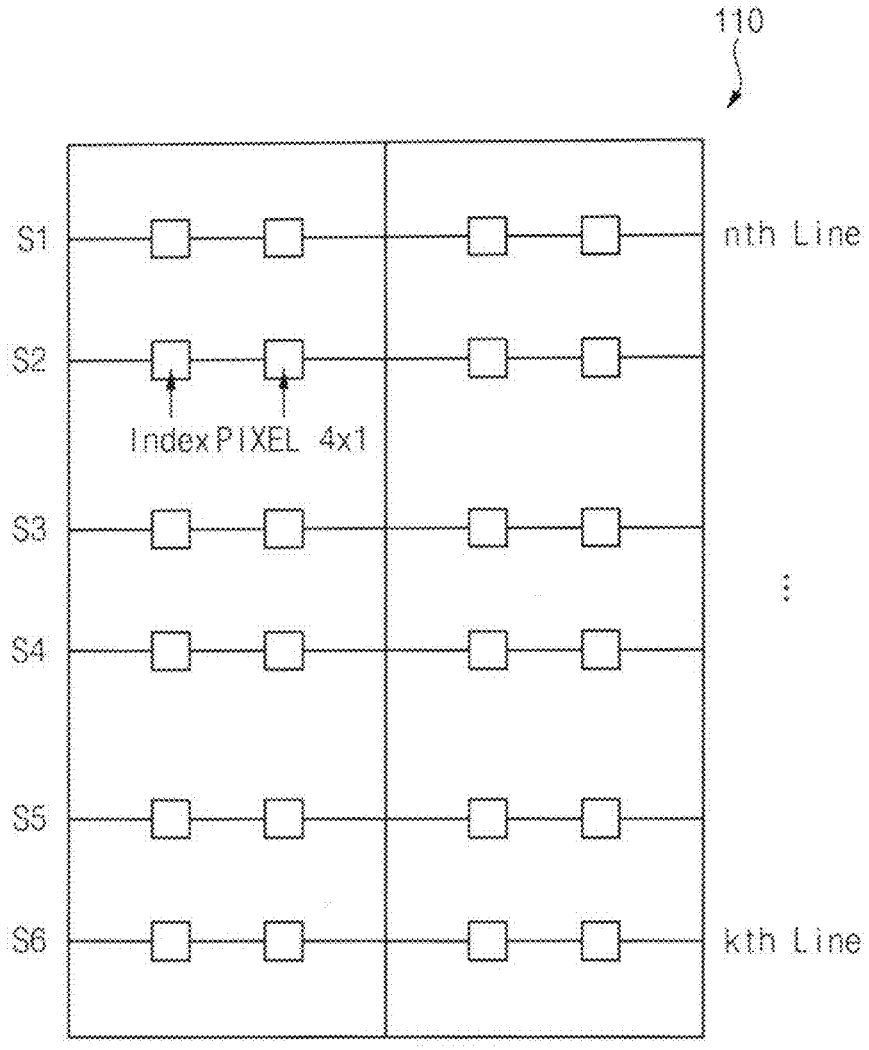
Figure 14:
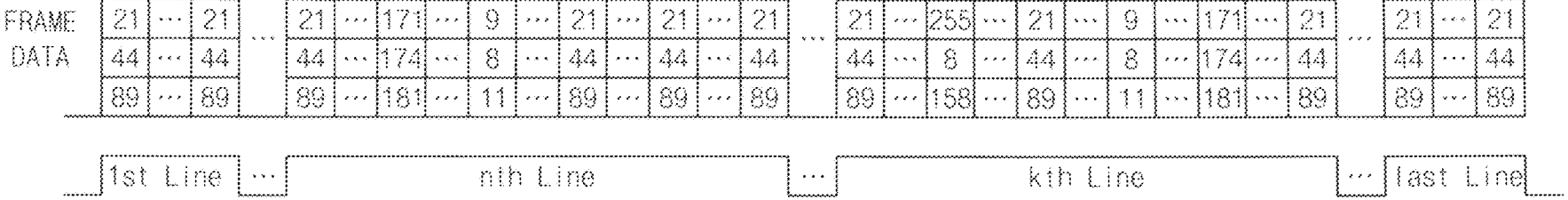

As shown in FIGS. 13 and 14, preset first to sixth rows 51 to S6 may be selected among the first to $i^{th}$ pixel rows in the display panel 110, the first to fourth regions may be selected from each of the first to sixth rows 51 to S6, and four pixels selected among the pixels overlapping the first to fourth regions may be selected. The four selected pixels may correspond to one index pixel. The calculator 131 may determine whether pixel data corresponding to the selected four pixels in the first region of the first row 51 is within the low gray level range. When all the pixel data corresponding to the selected four pixels are within the low gray level range, the calculator 131 may count one index pixel, and may count up all index pixels.

In an embodiment, the pixel data of FIGS. 13 and 14 may correspond to red pixel data, and the same process may be performed for green pixel data and blue pixel data.

Referring to FIGS. 2, 10, 15, and 16, after determining whether the pixel data corresponding to the index pixel is within the low gray level range, the calculator 131 may determine whether pixel data corresponding to a window index pixel is within the low gray level range. In this case, a window index pixel may correspond to pixels disposed in a preset region set in each of the first to $i^{th}$ pixel rows.

As shown in FIGS. 15 and 16, regions DE1_1, . . . , DE1_*m*, DE2_1, DE2_2, . . . , DEn_1, . . . , and DEn_k may be randomly set in each of the first to $i^{th}$ pixel rows in the display panel 110, pixels overlapping the regions DE1_1, . . . , DE1_*m*, DE2_1, DE2_2, . . . , DEn_1, . . . , and DEn_k may be selected, and the pixels may correspond to window index pixels. The calculator 131 may determine whether pixel data corresponding to pixels overlapping the region DE1_1 is within the low gray level range, a number of pixels within the low gray level range among the pixels (i.e., one window index pixel) overlapping the region DE1_1 may be counted, and a number of pixels within the low gray level range with respect to all window index pixels corresponding to the regions DE1_1 . . . DE1_*m*, DE2_1, DE2_2, . . . , DEn_1, . . . , and DEn_k may be counted. In an embodiment, the region DE1_1 may correspond to an n'th line and the region DE1_*m* may correspond to (n'+m)th line, and the region DEn_1 may correspond to a k'th line and the region DEn_k may correspond to a (k'+k)th line.

In an embodiment, the pixel data of FIGS. 15 and 16 may correspond to red pixel data, and the same process may be performed for green pixel data and blue pixel data.

Referring to FIGS. 2, 10, and 17, in a case where the total number of the pixel data within the low gray level range with respect to the frame data is less than or equal to the preset number, when a value obtained by counting up all the index pixels is greater than or equal to the preset criterion (e.g., the low-luminance pattern), the calculator 131 may determine that the offset is desired to be applied to the second initialization voltage VAINT. The compensation signal generator 133 may generate the compensation signal CS to provide the generated compensation signal CS to the power supply unit 160, and the power supply unit 160 may receive the compensation signal CS from the low frequency offset compensator 130 to apply the offset to the second initialization voltage VAINT. In addition, after the porch period in the third frame, the power supply unit 160 may receive the compensation signal CS from the low frequency offset compensator 130 to apply the offset to the second initialization voltage VAINT.

In an embodiment, even when the number of the pixel data within the low gray level range with respect to the frame data is less than or equal to the preset number, when pixels corresponding to the pixel data within the low gray level range are clustered in a preset region, a luminance decrease or a luminance increase (i.e., the luminance deviation) may be visually recognized in the clustered pixels (e.g., a low-luminance pattern), for example. Therefore, the calculator 131 may determine whether the pixel data within the low gray level range for all the index pixels has the low-luminance pattern.

In a case where the value obtained by counting up all the index pixels is less than or equal to the preset criterion, when the value obtained by counting the number of the pixels within the low gray level range for all window index pixels is greater than or equal to the preset criterion (e.g., the low-luminance pattern), the calculator 131 may determine that the offset is desired to be applied to the second initialization voltage VAINT. The compensation signal generator 133 may generate the compensation signal CS to provide the generated compensation signal CS to the power supply unit 160, and the power supply unit 160 may receive the compensation signal CS from the low frequency offset compensator 130 to apply the offset to the second initialization voltage VAINT. In addition, after the porch period in the third frame, the power supply unit 160 may receive the compensation signal CS from the low frequency offset compensator 130 to apply the offset to the second initialization voltage VAINT.

In an embodiment, even when the number of the pixel data within the low gray level range with respect to the frame data is less than or equal to the preset number, when pixels corresponding to the pixel data within the low gray level range are consecutively disposed in a preset region of adjacent pixel rows among the first to $i^{th}$ pixel rows (e.g., in a low-luminance pattern), the luminance deviation may be visually recognized in the pixels disposed in the preset region of the adjacent pixel rows, for example. Therefore, the calculator 131 may determine whether the pixel data within the low gray level range for all the window index pixels has the low-luminance pattern.

When the value obtained by counting the number of the pixels within the low gray level range for all the window index pixels is less than or equal to the preset criterion, the display device 100 may not apply the offset to the second initialization voltage VAINT.

Figure 18:
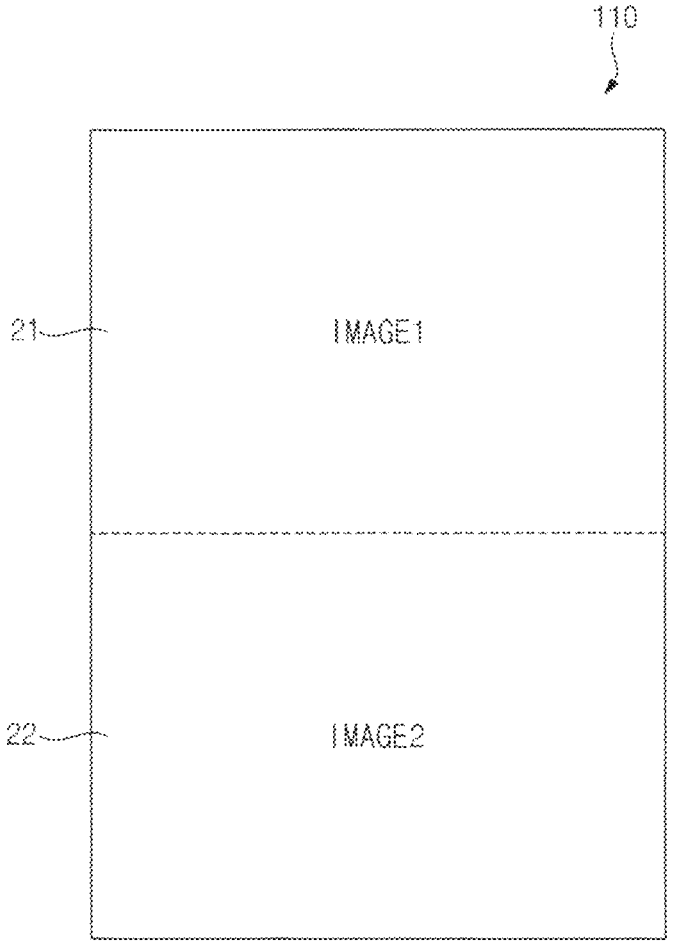
FIG. 18 is a block diagram showing an embodiment of a method of driving a display device according to the invention.
Figure 19:
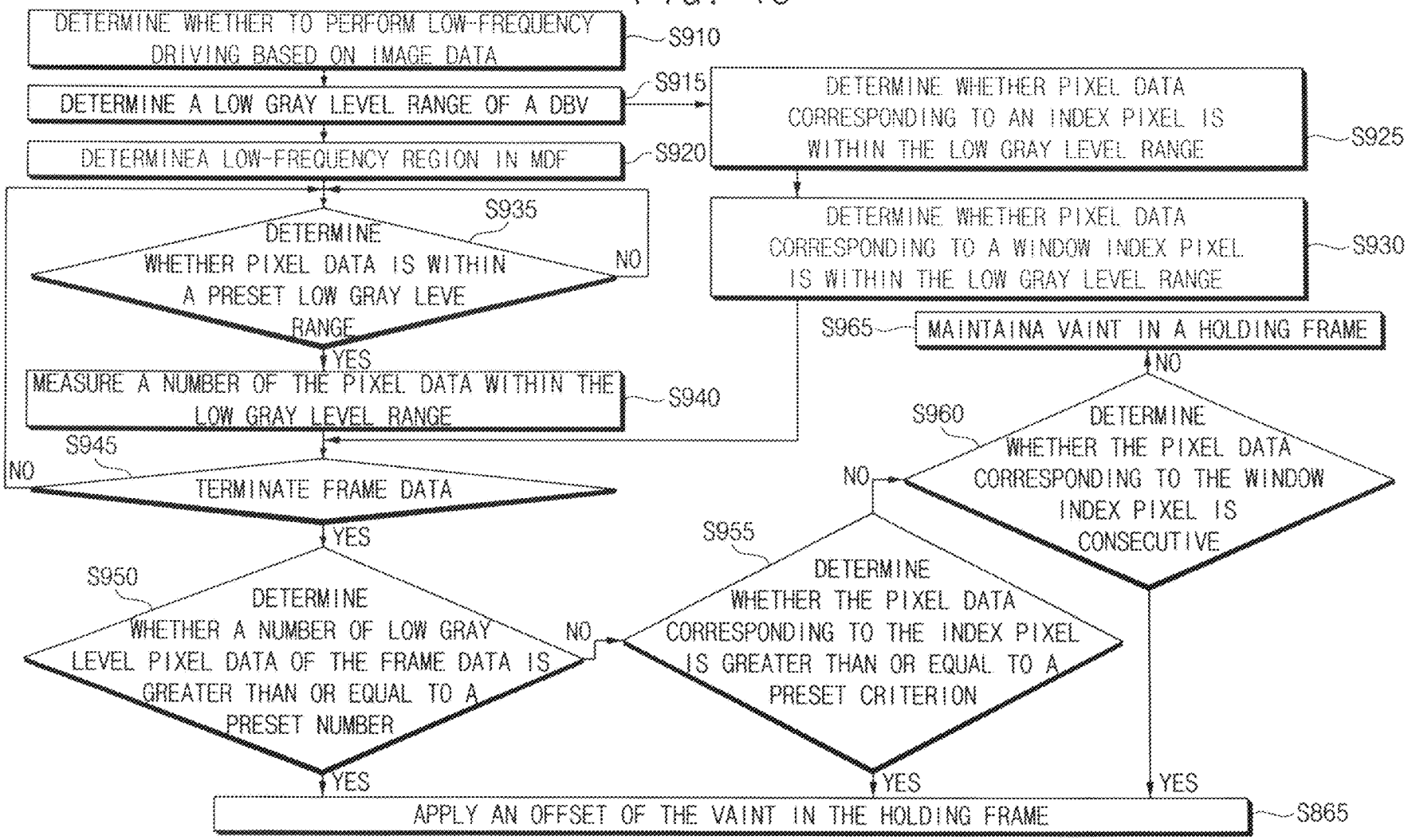
FIG. 19 is a flowchart showing the method of driving the display device of FIG. 18.
Figure 20:
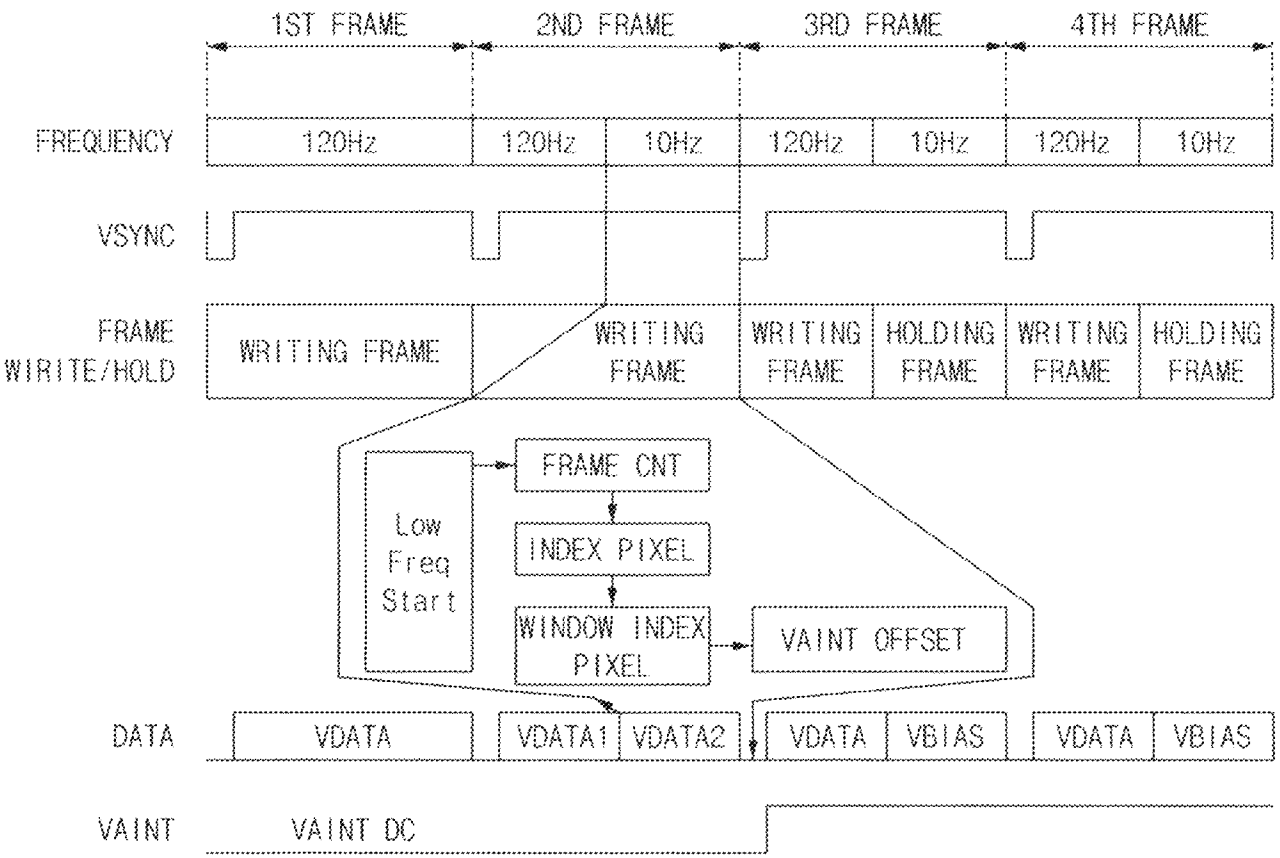
FIG. 20 is a timing diagram for describing the method of driving the display device of FIG. 19.

FIG. 18 is a block diagram showing a method of driving a display device in embodiments of the invention, FIG. 19 is a flowchart showing the method of driving the display device of FIG. 18, and FIG. 20 is a timing diagram for describing the method of driving the display device of FIG. 19. A display panel illustrated in FIGS. 18 to 20 may have a configuration that is substantially identical or similar to the configuration of the display panel 110 described with reference to FIGS. 9 to 17 except for including a first display area and a second display area. In FIGS. 18 to 20, redundant descriptions of components that are substantially identical or similar to the components described with reference to FIGS. 9 to 17 will be omitted.

Referring to FIG. 19, a method of driving a display device may include: determining whether to perform low-frequency driving based on image data (S910); determining a low gray level range of a DBV (S915); determining a low-frequency region in multi-frequency driving (hereinafter referred to as "MDF") (S920); determining whether pixel data is within a preset low gray level range (S925); determining whether pixel data corresponding to an index pixel is within the low gray level range (S930); determining whether pixel data corresponding to a window index pixel is within the low gray level range (S935); measuring a number of the pixel data within the low gray level range (S940); terminating frame data (S945); determining whether a number of low gray level pixel data of the frame data is greater than or equal to a preset number (S950); determining whether the pixel data corresponding to the index pixel is greater than or equal to a preset criterion (S955); determining whether the pixel data corresponding to the window index pixel is consecutive (S960); maintaining a second initialization voltage in a holding frame (S965); and applying an offset of the second initialization voltage in the holding frame (S970).

Referring to FIGS. 1, 18, and 20, the display panel 110 may include a first display area 21 and a second display area 22, and images IMAGE1 and IMAGE2 may be displayed in the first display area 21 and the second display area 22, respectively. In some embodiments, the first display area 21 of the display panel 110 may be driven at a high frequency, and the second display area 22 of the display panel 110 may be driven at a low frequency.

As shown in FIG. 20, in the first frame, the first display area 21 and the second display area 22 of the display panel 110 may be driven at 120 Hz (e.g., a high frequency), the first frame may correspond to a data write period, the data voltage VDATA may be provided to the pixel PX, and the offset may not be applied to the second initialization voltage VAINT.

Referring to FIGS. 1, 2, 18, and 19, the low frequency offset compensator 130 may receive the image data IMG, and receive the driving frequency information and the image data information (or the pixel data information) from the image data IMG. The calculator 131 may determine whether the second display area 22 of the display panel 110 is driven at the low frequency based on the image data IMG.

Referring to FIGS. 2, 19, and 20, when the second display area 22 of the display panel 110 is driven at the low frequency, the calculator 131 may select DBV data corresponding to a current brightness of the display panel among the DBV data stored in the memory 132, and determine a low gray level range of the selected DBV data.

As shown in FIG. 20, in the second frame, the first display area 21 of the display panel 110 may be driven at 120 Hz, and the second display area 22 of the display panel 110 may be driven at 10 Hz (e.g., a low frequency). However, the low frequency is not limited thereto, and in other embodiments, may be any substantially low frequencies. In an embodiment, the second frame may correspond to a data write period. In the second frame, a first data voltage VDATA1 may be provided to the pixel PX disposed in the first display area 21, and a second data voltage VDATA2 may be provided to the pixel PX disposed in the second display area 22. Furthermore, the offset may not be applied to the second initialization voltage VAINT in the second frame. In an embodiment, before the second data voltage VDATA2 is provided to the pixel PX in the second frame, the calculator 131 may determine whether the second display area 22 of the display panel 110 is driven at a low frequency based on the image data IMG, and when the second display area 22 of the display panel 110 is driven at the low frequency, the calculator 131 may recognize the low-frequency driving of the second display area 22 of the display panel 110. In other words, the calculator 131 may determine the second display area 22 that is a low-frequency area in the MDF.

Referring to FIGS. 2 and 19, after the low gray level range of the selected DBV data is determined, the calculator 131 may determine whether the pixel data corresponds within the preset low gray level range based on gray level information included in each of the pixel data corresponding to the second display area 22.

After the calculator 131 determines whether each of the pixel data corresponds within the preset low gray level range, the calculator 131 may measure a number of pixel data corresponding within the low gray level range with respect to the pixel data corresponding to the pixel rows corresponding to the second display area 22 among the first to $i^{th}$ pixel rows.

After the above process is completely performed, the frame data may be terminated (or the measurement of the total number of the pixel data corresponding within the low gray level range with respect to the frame data corresponding to the second display area 22 may be terminated).

Referring to FIGS. 1, 2, 19, and 20, after the measurement of the number of the pixel data within the low gray level range with respect to the frame data corresponding to the second display area 22 ends, the calculator 131 may determine whether a total number of the pixel data within the low gray level range with respect to the frame data corresponding to the second display area 22 is greater than or equal to a preset number.

When the total number of pixel data within the low gray level range with respect to the frame data corresponding to the second display area 22 is greater than or equal to the preset number, the calculator 131 may determine that the offset is desired to be applied to the second initialization voltage VAINT, and the compensation signal generator 133 may generate the compensation signal CS to provide the generated compensation signal CS to the power supply unit 160. The power supply unit 160 may receive a compensation signal CS from the low frequency offset compensator 130 to apply an offset to the second initialization voltage VAINT. In other words, only when the second display area 22 of the display panel 110 is driven at the low frequency, and the image displayed in the second display area 22 has a low luminance, the display device may apply the offset to the second initialization voltage VAINT.

As shown in FIG. 20, in the third frame, the first display area 21 of the display panel 110 may be driven at 120 Hz, and the second display area 22 of the display panel 110 may be driven at 10 Hz. In an embodiment, in the third frame, the first display area 21 may correspond to a data write period, and the data voltage VDATA may be provided to the pixel PX disposed in the first display area 21. In the third frame, the second display area 22 may correspond to a holding frame period, and the bias power supply voltage VBIAS may be provided to the pixel PX disposed in the second display area 22. Furthermore, the offset may be applied to the second initialization voltage VAINT in the third frame. In an embodiment, the calculator 131 may determine that the offset is desired to be applied to the second initialization voltage VAINT during the porch period of the vertical synchronization signal VSYNC in the third frame, the compensation signal generator 133 may generate the compensation signal CS to provide the generated compensation signal CS to the power supply unit 160, and the power supply unit 160 may receive the compensation signal CS from the low frequency offset compensator 130 to apply the offset to the second initialization voltage VAINT. In addition, after the porch period in the third frame, the power supply unit 160 may receive the compensation signal CS from the low frequency offset compensator 130 to apply the offset to the second initialization voltage VAINT.

Referring to FIGS. 2 and 19, after the low gray level range of the selected DBV data is determined, the calculator 131 may determine whether pixel data corresponding to an index pixel (or an index pixel group) in the second display area 22 is within the low gray level range.

Referring to FIGS. 2 and 19, after determining whether the pixel data corresponding to the index pixel in the second display area 22 is within the low gray level range, the calculator 131 may determine whether pixel data corresponding to a window index pixel in the second display area 22 is within the low gray level range.

Referring to FIGS. 2, 19, and 20, in a case where the total number of the pixel data within the low gray level range with respect to the frame data corresponding to the second display area is less than or equal to the preset number, when a value obtained by counting up all the index pixels in the second display area is greater than or equal to the preset criterion (e.g., the low-luminance pattern), the calculator 131 may determine that the offset is desired to be applied to the second initialization voltage VAINT. The compensation signal generator 133 may generate the compensation signal CS to provide the generated compensation signal CS to the power supply unit 160, and the power supply unit 160 may receive the compensation signal CS from the low frequency offset compensator 130 to apply the offset to the second initialization voltage VAINT. In addition, after the porch period in the third frame, the power supply unit 160 may receive the compensation signal CS from the low frequency offset compensator 130 to apply the offset to the second initialization voltage VAINT.

In a case where the value obtained by counting up all the index pixels in the second display area 22 is less than or equal to the preset criterion, when the value obtained by counting the number of the pixels within the low gray level range for all the window index pixels in the second display area 22 is greater than or equal to the preset criterion (e.g., the low-luminance pattern), the calculator 131 may determine that the offset is desired to be applied to the second initialization voltage VAINT. The compensation signal generator 133 may generate the compensation signal CS to provide the generated compensation signal CS to the power supply unit 160, and the power supply unit 160 may receive the compensation signal CS from the low frequency offset compensator 130 to apply the offset to the second initialization voltage VAINT. In addition, after the porch period in the third frame, the power supply unit 160 may receive the compensation signal CS from the low frequency offset compensator 130 to apply the offset to the second initialization voltage VAINT.

When the value obtained by counting the number of the pixels within the low gray level range for all the window index pixels is less than or equal to the preset criterion, the display device may not apply the offset to the second initialization voltage VAINT.

Figure 21:
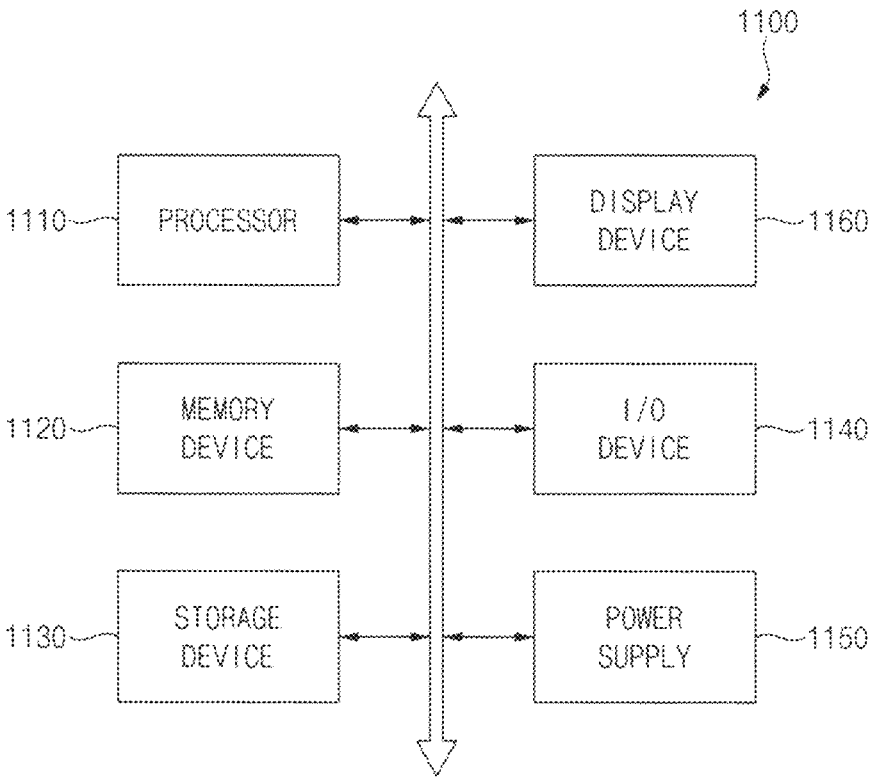
FIG. 21 is a block diagram illustrating an electronic device including a display device according to the invention.

FIG. 21 is a block diagram illustrating an electronic device including a display device according to the invention.

Referring to FIG. 21, an electronic device 1100 may include a processor 1110, a memory device 1120, a storage device 1130, an input/output ("I/O") device 1140, a power supply 1150, and a display device 1160. The electronic device 1100 may further include a plurality of ports for communicating with a video card, a sound card, a memory card, a universal serial bus ("USB") device, other electric devices, etc.

The processor 1110 may perform various computing functions or tasks. The processor 1110 may be an application processor ("AP"), a microprocessor, a central processing unit ("CPU"), etc. The processor 1110 may be coupled to other components via an address bus, a control bus, a data bus, etc. Further, in embodiments, the processor 1110 may be further coupled to an extended bus such as a peripheral component interconnection ("PCI") bus.

The memory device 1120 may store data for operations of the electronic device 1100. In an embodiment, the memory device 1120 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc., and/or at least one volatile memory device such as a dynamic random access memory ("DRAM") device, a static random access memory ("SRAM") device, a mobile dynamic random access memory ("mobile DRAM") device, etc.

The storage device 1130 may be a solid state drive ("SSD") device, a hard disk drive ("HDD") device, a CD-ROM device, etc. The I/O device 1140 may be an input device such as a keyboard, a keypad, a mouse, a touch screen, etc., and an output device such as a printer, a speaker, etc. The power supply 1150 may supply power for operations of the electronic device 1100. The display device (e.g., OLED display device) 1160 may be coupled to other components through the buses or other communication links.

The display device 1160 may include a display panel including a plurality of pixels, a controller, a data driver, a gate driver, an emission driver, a power supply unit, a low frequency offset compensator, or the like. Here, the low frequency offset compensator may include a calculator, a memory, and a compensation signal generator. In an embodiment, as the display device 1160 includes the low frequency offset compensator, when the display panel is driven at a low frequency, the luminance deviation may be prevented from occurring in the pixels of the display panel by selectively applying the offset to the second initialization voltage.

In an embodiment, the electronic device 1100 may be any electronic device including the display device 1160 such as a smart phone, a wearable electronic device, a tablet computer, a mobile phone, a television ("TV"), a digital TV, a three dimensional ("3D") TV, a personal computer ("PC"), a home appliance, a laptop computer, a personal digital assistant ("PDA"), a portable multimedia player ("PMP"), a digital camera, a music player, a portable game console, a navigation device, or the like.

Embodiments of the invention may be applied to various electronic devices including a display device. The disclosure may be applied to numerous electronic devices such as vehicle-display devices, ship-display devices, aircraft-display devices, portable communication devices, exhibition display devices, information transfer display devices, medical-display devices, etc., for example.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the invention. Accordingly, all such modifications are intended to be included within the scope of the invention as defined in the claims. Therefore, it is to be understood that the foregoing is illustrative of various embodiments and is not to be construed as limited to the illustrative embodiments disclosed, and that modifications to the disclosed embodiments, as well as other embodiments, are intended to be included within the scope of the appended claims.

What is claimed is:

1. A display device comprising:

a display panel including a plurality of pixels;

a power supply unit which generates a first initialization voltage and a second initialization voltage and provides the first initialization voltage and the second initialization voltage to the plurality of pixels; and a low frequency offset compensator which selectively applies an offset to the second initialization voltage when the display panel is driven at a low frequency, wherein the low frequency offset compensator measures a number of pixel data corresponding within a preset low gray level range based on gray level information of the pixel data included in image data.

2. The display device of claim 1, wherein the low frequency offset compensator applies the offset to the second initialization voltage when the number of the pixel data corresponding within the preset low gray level range is greater than or equal to a preset number.

3. The display device of claim 1, wherein the low frequency offset compensator does not to apply the offset to the second initialization voltage when the number of the pixel data corresponding within the preset low gray level range is less than or equal to a preset criterion.

4. The display device of claim 1, wherein the preset low gray level range is from about 0.2 nit to about 1 nit.

5. The display device of claim 1, wherein the low frequency offset compensator includes:

a memory which stores display brightness value data and a low gray level range corresponding to each of the display brightness value data;

a calculator which determines whether the display panel is driven at the low frequency based on the image data, select display brightness value data corresponding to a brightness of the display panel, and determine a low gray level range of the selected display brightness value data; and a compensation signal generator which generates a compensation signal and provides the compensation signal to the power supply unit.

6. The display device of claim 1, wherein the low frequency offset compensator determines whether pixel data corresponding to an index pixel group corresponding to at least four discrete pixels selected from pixels arranged in a pixel row among the plurality of pixels is within a low gray level range.

7. The display device of claim 6, wherein the low frequency offset compensator applies the offset to the second initialization voltage when the pixel data corresponding to an index pixel within the low gray level range is greater than or equal to a preset criterion.

8. The display device of claim 1, wherein the low frequency offset compensator determines whether pixel data corresponding to a window index corresponding to at least four consecutive pixels selected from pixels arranged in a pixel row among the plurality of pixels is within a low gray level range.

9. The display device of claim 8, wherein the low frequency offset compensator applies the offset to the second initialization voltage when the pixel data corresponding to a window index pixel within the low gray level range is greater than or equal to a preset criterion.

10. The display device of claim 1, wherein each of the plurality of pixels includes:

a light-emitting element which outputs a light based on a driving current, and including a first terminal and a second terminal; and a driving transistor which generates the driving current, and includes a first terminal to which a first power supply voltage is applied, a second terminal connected to the first terminal of the light-emitting element, and a gate terminal to which the first initialization voltage is applied.

11. The display device of claim 10, wherein each of the plurality of pixels further includes a first switching transistor including a first terminal to which the second initialization voltage is applied, a second terminal connected to the first terminal of the light-emitting element, and a gate terminal to which a data write gate signal is applied.

12. The display device of claim 11, wherein the first switching transistor initializes the first terminal of the light-emitting element to the second initialization voltage during an activation period of the data write gate signal.

13. The display device of claim 10, wherein each of the plurality of pixels further includes a second switching transistor including a first terminal to which the first initialization voltage is applied, a second terminal connected to the gate terminal of the driving transistor, and a gate terminal to which a data initialization gate signal is applied.

14. The display device of claim 13, wherein the second switching transistor initializes the gate terminal of the driving transistor to the first initialization voltage during an activation period of the data initialization gate signal.

15. A method of driving a display device, the method comprising:

determining whether to perform low-frequency driving based on image data;

determining a low gray level range of display brightness value data corresponding to a brightness of a display panel among the display brightness value data;

determining whether pixel data is within a preset low gray level range;

measuring a number of the pixel data within the preset low gray level range;

determining whether a number of low gray level pixel data of frame data is greater than or equal to a preset number; and applying an offset of a second initialization voltage in a holding frame when the number of the low gray level pixel data of the frame data is greater than or equal to the preset number.

16. The method of claim 15, wherein the preset low gray level range is from about 0.2 nit to about 1 nit.

17. The method of claim 15, further comprising:

determining whether pixel data corresponding to an index pixel is within the preset low gray level range; and determining whether the pixel data corresponding to the index pixel is greater than or equal to a preset criterion.

18. The method of claim 15, further comprising:

determining whether pixel data corresponding to a window index pixel is within the preset low gray level range; and determining whether the pixel data corresponding to the window index pixel is consecutive.

19. The method of claim 15, further comprising maintaining the second initialization voltage in the holding frame when the number of the low gray level pixel data of the frame data is less than or equal to the preset number.

* * * * *